US010260302B2

(12) United States Patent
Balasubramanian et al.

(10) Patent No.: US 10,260,302 B2
(45) Date of Patent: Apr. 16, 2019

(54) CUTTING INSERT FOR INITIATING A CUTOUT

(71) Applicant: Schlumberger Technology Corporation, Sugar Land, TX (US)

(72) Inventors: Nagarajan Balasubramanian, Houston, TX (US); Sike Xia, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 462 days.

(21) Appl. No.: 14/737,567

(22) Filed: Jun. 12, 2015

(65) Prior Publication Data

US 2015/0376966 A1 Dec. 31, 2015

Related U.S. Application Data

(60) Provisional application No. 62/017,049, filed on Jun. 25, 2014.

(51) Int. Cl.
*E21B 29/00* (2006.01)
*E21B 29/06* (2006.01)

(52) U.S. Cl.
CPC ..... *E21B 29/005* (2013.01); *E21B 29/002* (2013.01); *E21B 29/06* (2013.01)

(58) Field of Classification Search
CPC ..... E21B 29/00; E21B 29/005; E21B 29/002; E21B 29/06
USPC ..... 166/298
See application file for complete search history.

(56) References Cited

U.S. PATENT DOCUMENTS 2,644,670 A * 7/1953 Baker ..... E21B 10/322 175/269
2,846,193 A * 8/1958 Chadderdon ..... E21B 29/00 166/55.7
4,938,291 A 7/1990 Lynde et al.
5,012,863 A * 5/1991 Springer ..... E21B 10/46 166/55.7
5,070,952 A * 12/1991 Neff ..... E21B 10/322 166/55.7
5,201,817 A * 4/1993 Hailey ..... E21B 10/322 166/55.8
5,242,017 A 9/1993 Hailey
(Continued)

FOREIGN PATENT DOCUMENTS

EP 0341073 A1 11/1989

OTHER PUBLICATIONS

Shaw, Milton C., "Metal Cutting Principles," 1999, pp. 442-463 and 524-527, CBS Publishers & Distributors, New Delhi, India.
(Continued)

*Primary Examiner* — George S Gray

(57) ABSTRACT

A milling tool includes a cutting insert coupled to a movable blade. The movable blade may change from a retracted to an expanded state to engage and cut downhole casing. A cutout initiation region of the movable blade makes contact with the downhole casing, and cutting inserts with turning portions designed to cut in a turning manner may be located in the cutout initiation region. Cutting inserts with milling portions designed to cut in a face-milling manner may be located outside the cutout initiation region. Some cutting inserts may include both turning portions and milling portions.

19 Claims, 15 Drawing Sheets

(56) References Cited

U.S. PATENT DOCUMENTS

| | | | | | |
|---|---|---|---|---|---|
| 5,373,900 | A * | 12/1994 | Lynde | B23L 35/16 | 166/297 |
| 5,392,862 | A | 2/1995 | Swearingen | | |
| 5,456,312 | A | 10/1995 | Lynde et al. | | |
| 5,626,189 | A | 5/1997 | Hutchinson | | |
| 5,778,995 | A | 7/1998 | McGarian | | |
| 5,810,079 | A | 9/1998 | Lynde et al. | | |
| 5,862,870 | A * | 1/1999 | Hutchinson | E21B 29/005 | 166/55.8 |
| 5,899,268 | A | 5/1999 | Lynde et al. | | |
| 5,908,071 | A | 6/1999 | Hutchinson et al. | | |
| 5,979,571 | A | 11/1999 | Scott et al. | | |
| 5,984,005 | A | 11/1999 | Hart et al. | | |
| 6,125,929 | A * | 10/2000 | Davis | E21B 29/005 | 166/298 |
| 6,131,675 | A | 10/2000 | Anderson | | |
| 6,170,576 | B1 | 1/2001 | Brunnert et al. | | |
| 7,108,064 | B2 | 9/2006 | Hart et al. | | |
| 8,555,955 | B2 | 10/2013 | Davis | | |
| 8,876,440 | B2 | 11/2014 | Nam et al. | | |
| 2005/0109546 | A1 | 5/2005 | Stowe et al. | | |
| 2010/0089583 | A1 * | 4/2010 | Xu | E21B 10/322 | 166/298 |
| 2011/0220357 | A1 | 9/2011 | Segura et al. | | |
| 2011/0315448 | A1 * | 12/2011 | Stowe, II | B24D 99/005 | 175/57 |
| 2012/0152543 | A1 * | 6/2012 | Davis | E21B 10/66 | 166/298 |
| 2013/0336735 | A1 | 12/2013 | Nam et al. | | |
| 2014/0166305 | A1 * | 6/2014 | Grigor | E21B 29/002 | 166/376 |

OTHER PUBLICATIONS

European Search and Examination Report R.62 EPC issued in European Patent Application No. 15173675.8 dated Jan. 30, 2017, 13 pages.

Wamontgomeryl3's channel: "Vega Duplicator Wood Lathe Demonstration", Nov. 28, 2012, p. I, XP054976654, accessed at https://www.youtube.com/watch?v=2tzKazf-vUY.

First Office Action and Search Report issued in Chinese Patent Application No. 201510359207.2 dated Mar. 20, 2017, 14 pages.

Second Office Action issued in Chinese Patent Application No. 201510359207.2 dated Mar. 20, 2017, 7 pages.

* cited by examiner

CUTTING INSERT FOR INITIATING A CUTOUT

CROSS-REFERENCE TO RELATED APPLICATIONS

This application claims the benefit of, and priority to, U.S. Patent Application Ser. No. 62/017,049, filed Jun. 25, 2014, which application is expressly incorporated herein by this reference.

BACKGROUND

When drilling an oil and gas well, one or more casing strings are installed and cemented in a wellbore as drilling progresses to increasing depths. The casing strings may provide stability to limit cave-ins in unstable formations, and may isolate the wellbore from the surrounding formation. As a result, the casing strings can seal off high-pressure zones from the surface and prevent fluid loss or contamination of production zones. The casing strings may also provide a smooth internal surface for installing production equipment.

Once the oil and gas well is no longer commercially viable, the well may be abandoned, or slot recovery may be performed to use the wellbore as a kickoff point for sidetracking and the formation of a lateral borehole. Removal of a portion of a casing string for well abandonment or slot recovery operations may include performing a section milling operation. Section mill blades are in a retracted or inactive state when the milling tool is tripped into the wellbore. Upon reaching a desired depth, the section mill blades are expanded into a radially outward, active state that engages the casing. As the milling tool and milling blades are rotated in the wellbore, the blades make a circumferential cut in the casing string. The tool string is then urged downhole while rotation continues so as to axially mill away a desired length of the casing string.

SUMMARY

According to one or more embodiments, a cutting insert may include a turning portion for initiating a cutout and cutting radially into a workpiece. The cutting insert may also include a milling portion that extends the cutout by cutting axially along the workpiece. In some embodiments, a cutting insert may include a first portion having features arranged to cut radially into a workpiece, and a second portion having features arranged to mill axially along a workpiece. In further example embodiments, a cutting insert for initiating a cutout may include a cutout initiation portion configured to initiate a cutout by cutting radially into a workpiece. The cutting insert may also include a milling portion configured to extend the cutout by face milling axially along the workpiece.

A method of forming a movable blade is also disclosed according to one or more embodiments herein. A first type of cutting insert may be coupled to a cutout initiation region of the movable blade. A second type of cutting insert may then be coupled to the movable blade, outside of the cutout initiation region. The first type of cutting insert may be used in turning operations to cut radially into a workpiece. The second type of cutting insert may be used in milling operations to cut axially along a workpiece.

According to another embodiment, a section mill may include a moveable blade. The movable blade may include a cutting insert with a turning portion coupled thereto.

Another example section mill may include a body and a movable blade coupled thereto. The movable blade may include cutting inserts that define cutout initiation and face milling regions of the movable blade.

Methods of milling casing may, in some embodiments, include inserting a mill into a wellbore while a movable blade of the mill is in a retracted position. The movable blade may include a turning portion and a milling portion. The mill may be activated and the movable blade expanded radially outward, which may cause the turning portion to contact casing lining the wellbore. A cutout may also be initiated in the casing by rotating the movable blade and causing the turning portion to cut radially into the casing. The cutout may be extended in the casing by using the milling portion to cut axially along the casing. Another example method of milling casing includes inserting a mill into a wellbore while at least one movable blade is in a retracted position. The at least one movable blade includes a cutout initiation region and a milling region. A radial cutout is initiated in the casing by the cutout initiation region when rotating the at least one movable blade and expanding the at least one movable blade radially outwardly. The cutout is extended by using the at least one milling region to cut axially along the casing.

According to an embodiment, a cutting insert includes a first portion having features arranged to cut radially through and into a workpiece having an outer surface, such that the first portion cuts radially to a distance such that the entire first portion is beyond the workpiece outer surface. The first portion has a first length and includes a front milling face and a top milling face coupled to the front milling face at a milling cutting edge. The cutting insert also includes a second portion having features arranged to mill axially along a workpiece. The second portion is coupled to the first portion and has a second length, with the first and second lengths collectively defining a total length. The second portion features include a front turning face coupled to the front milling face, a top turning face coupled to the front turning face at a side cutting edge, and an end turning face coupled to the top turning face at an end cutting edge. The side cutting edge is at a non-zero angle relative to a first reference line parallel to the total length, and the end cutting edge is at a non-zero end cutting edge angle relative to a second reference line perpendicular to the first reference line.

According to another embodiment, a section mill is described for milling a tubular having an outer surface. The section mill includes a body and a movable blade movably coupled to the body. A plurality of cutting inserts are coupled to the movable blade and include at least one first cutting element positioned along at least a portion of an outer radial edge of the movable blade to initiate a cutout radially. The at least one first cutting element includes a radially outer portion that includes a front turning face, a top turning face coupled to the front turning face at a side cutting edge, and an end turning face coupled to the top turning face at an end cutting edge. The side cutting edge is at a non-zero side cutting edge angle relative to a first reference line parallel to a radial length of the at least one first cutting element, and the end cutting edge is at a non-zero end cutting edge angle relative to a second reference line perpendicular to the first reference line. The plurality of cutting elements also include at least one second cutting element on the movable blade and positioned radially inward of the at least one first cutting element for extending the cutout axially at least when the at least one first cutting element has radially cut to a distance such that a radially outermost first cutting element of the at least one first cutting element is entirely beyond the outer surface of the tubular. The at least one second cutting element has a different shape than the at least one first cutting element.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict just some example embodiments and are not to be considered to be limiting in scope, nor drawn to scale for each embodiment contemplated hereby, various embodiments will be described and explained with additional specificity and detail through the use of the accompanying drawings in which:

FIG. 4-1 is a perspective view of an example milling insert for initiating a cutout in downhole casing, in accordance with one or more embodiments of the present disclosure;

FIGS. 4-2 is a top view of the milling insert of FIG. 4-1, in accordance with one or more embodiments of the present disclosure;

FIGS. 4-3 to 4-6 are various side views of the milling insert of FIG. 4-1, in accordance with one or more embodiments of the present disclosure;

FIG. 5-1 is a perspective view of an example milling insert for initiating a cutout in downhole casing and for section milling, in accordance with one or more embodiments of the present disclosure;

FIG. 5-2 is a top view of the milling insert of FIG. 5-1, in accordance with one or more embodiments of the present disclosure;

FIG. 5-3 is a side view of the milling insert of FIG. 5-1, in accordance with one or more embodiments of the present disclosure;

FIGS. 6 to 10 are side views of additional examples of milling inserts for initiating a cutout in downhole casing and for section milling, in accordance with additional embodiments of the present disclosure;

FIGS. 12-1 to 12-4 are partial cross-sectional views of a section mill blade used in a section milling process for initiating a cutout in downhole casing and for section milling, in accordance with one or more embodiments of the present disclosure;

DETAILED DESCRIPTION

In accordance with some aspects of the present disclosure, embodiments herein relate to downhole tools. More particularly, embodiments disclosed herein may relate to downhole tools and bottomhole assemblies ("BHA") that include a mill. An example BHA may include a section mill for cutting casing for use in wellbore abandonment, slot recovery, or other downhole operations. In still other aspects, embodiments of the present disclosure may relate to milling inserts that may be used on a mill blade to initiate a cutout of casing and to section mill the casing by milling axially on the casing.

Figure 1:
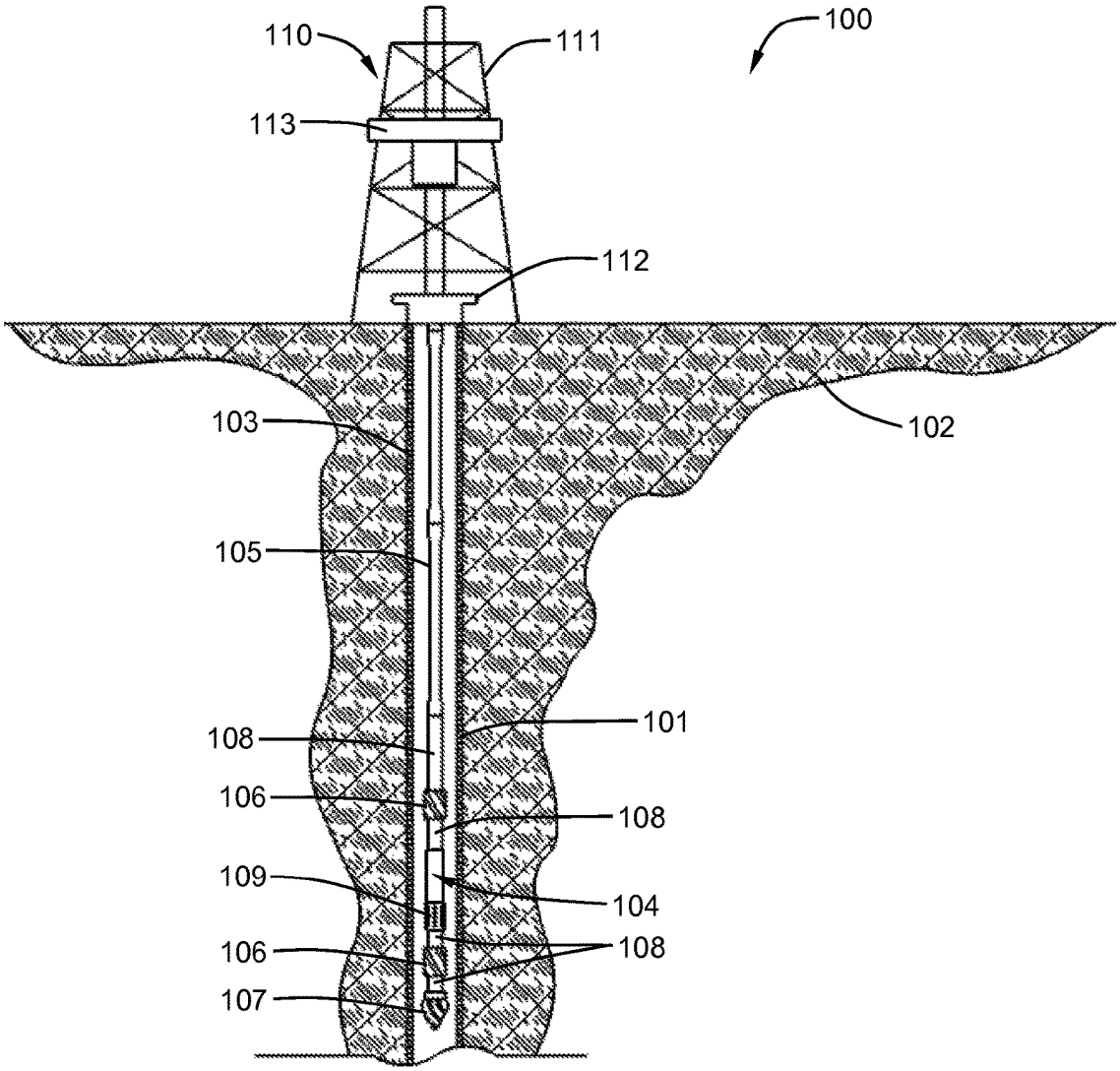
FIG. 1 is a schematic illustration of an example downhole milling system, in accordance with one or more embodiments of the present disclosure.

Referring now to FIG. 1, a schematic diagram is provided of an example downhole system 100 that may utilize milling systems, assemblies, devices, and methods in accordance with embodiments of the present disclosure. FIG. 1 shows an example wellbore 101 formed in a formation 102. In this particular embodiment the wellbore 101 includes a casing 103 installed therein. The casing 103 may extend along a full length of the wellbore 101; however, in other embodiments, the wellbore 101 may be an openhole wellbore that is uncased. In still other embodiments, the wellbore 101 may include both cased portions and openhole portions.

In the particular embodiment illustrated in FIG. 1, a BHA 104 may be provided to facilitate milling of the casing 103 so as to expose one or more outer layers of casing, the formation 102, or the like. The BHA 104 may be connected to a drill string 105. In FIG. 1, the drill string 105 is illustrated as extending from the surface and having the BHA 104 suspended therefrom. The drill string 105 may be composed of one or more tubular members. The tubular members of the drill string 105 may themselves have any number of configurations. As an example, the drill string 105 may include segmented/jointed drill pipe, wired drill pipe, coiled tubing, or the like.

The BHA 104 may include any number of components that may be used to perform one or more downhole operations. As an example, the BHA 104 may include one or more stabilizers 106, a bit 107, other components 108, one or more mills 109, or any combination of the foregoing. In some embodiments, the stabilizers 106 may be used to maintain the BHA 104 in a centered position within the wellbore 101. In at least some embodiments, such centralization may reduce or minimize vibrations within the BHA 104 and drill string 105 during a downhole operation, may center the bit 107, mill 109, or other components during a remedial or other operation, or provide other features.

The bit 107 may be a drill bit for drilling into the formation 102 surrounding the wellbore 101 and expanding the length of the primary wellbore. In other embodiments, however, the bit 107 may have other structures or uses. For instance, the bit 107 may be a milling bit for milling the casing 103 (e.g., during a sidetracking or wellbore departure operation), grinding up downhole tools or swarf during a remedial operation, or the like. In still other embodiments, the bit 107 may include a reamer for expanding the diameter of the wellbore 101.

In the particular embodiment shown in FIG. 1, one or more mills 109 may be provided. The mills 109 may take any number of forms, and may include, by way of example, casing mills, section mills, junk mills, other types of mills, or some combination of the foregoing. In at least some embodiments, the one or more mills 109 may include one or more blades that may be used to mill the casing 103, downhole tools, or junk within the wellbore 101. In at least some embodiments, the mill 109 may include blades that can be selectively expanded and retracted. For instance, when the BHA 104 is inserted into the wellbore 101, the blades may be in a retracted state. Upon reaching a desired depth, formation structure, or the like, a signal may be sent from the surface (e.g., through wireless, mud pulse, fluid pressure, ball drop, string rotation, or other activation techniques) to expand the blades so that they engage and cut the casing 103 or other components within or around the wellbore 101.

The particular components included on the BHA 104 may be varied in any number manners, and the BHA 104 may include additional or other components 108 for use in any number of manners. By way of example, the other components 108 of the BHA 104 may include one or more logging-while-drilling or measurement-while-drilling components (e.g., sensors, measurement devices, logging devices, rotational velocity sensors, pressure sensors, cameras or visibility devices, proximity sensors, direction sensors, inclination sensors, survey sensors, resistivity sensors, density sensors, porosity sensors, torque sensors, weight-on-bit sensors, or other sensors or instrumentation), memory or data storage devices, motors (e.g., mud motors, turbine motors, positive displacement motors, etc.), rotary steerable and directional drilling equipment (e.g., point-the-bit components, push-the-bit components, pad-in-bit components), wellbore departure equipment (e.g., whipstocks), activation equipment (e.g., activation/deactivation subs), disconnect subs or equipment, circulation subs, communication equipment (e.g., pulsers, a signal processor, acoustic processors, wireless processors, signal boosters, fiber optic components, mud pulse telemetry receivers/transmitters), fishing/retrieval equipment, cleaning nozzles, reentry components, perforation or fracking equipment, plugs, anchors, packers, isolation/sealing devices, plugs, liner hangers, other devices or tools, or some combination of the foregoing.

As shown in FIG. 1, a drilling rig 110 may be used to convey the drill string 105 and BHA 104 into the wellbore 101. In an example embodiment, the drilling rig 110 may include a derrick and hoisting system 111, a rotating system, a mud circulation system, or other components. The derrick and hoisting system 111 may suspend the drill string 105, and the drill string 105 may pass through a wellhead 112 and into the wellbore 101. In some embodiments, the drilling rig 110 or derrick and hoisting system 111 may include a draw works, a fast line, a crown block, drilling line, a traveling block and hook, a swivel, a deadline, or other components. An example rotating system may be used, for instance, to rotate the drill string 105 and thereby also rotate one or more components of the BHA 104. In the illustrated embodiment, the rotating system may include a top drive 113; however, other embodiments may contemplate the use of a kelly, rotary table, or other components. Although the downhole system 100 is shown in FIG. 1 as being on land, those of skill in the art will recognize that embodiments of the present disclosure are also equally applicable to offshore and marine environments.

As discussed herein, the mill 109 of the BHA 104 may be a section mill. In operation, one or more blades of a section mill may be selectively retracted and/or expanded. For instance, the one or more blades may be in a retracted state as the section mill is inserted into the wellbore 101. Upon reaching a desired depth, the mill 109 may be activated and the one or more blades may be expanded using mechanical actuation, hydraulic actuation, or the like. The blades may expand radially outward and contact the casing 103 lining the wellbore 101. As the one or more blades expand radially outward, rotation of the mill may then be used to initially cut radially outward from the inside surface of the casing 103 to the outside surface of the casing 103. As the initial cut is made, an opening or "cutout" is initiated and begins to form in the casing 103. During or after initiation of the cutout, the expanded blades may also be moved axially upward/uphole or downward/downhole to increase the axial length and extend the cutout in the casing 103. When milling occurs by moving the BHA in a downward/downhole direction, the rotation of the expanded blades and the weight-on-mill of the section mill may be used to mill the casing 103. When milling occurs by moving the BHA 104 in an upward/uphole direction, the rotation of the expanded blades and the axially directed, upward force may be used to mill the casing 103. The milled-out, and potentially openhole, portion of the wellbore 101 may then be suitable for rock-to-rock plugging, slot recovery, sidetracking, or other operations.

Figure 2:
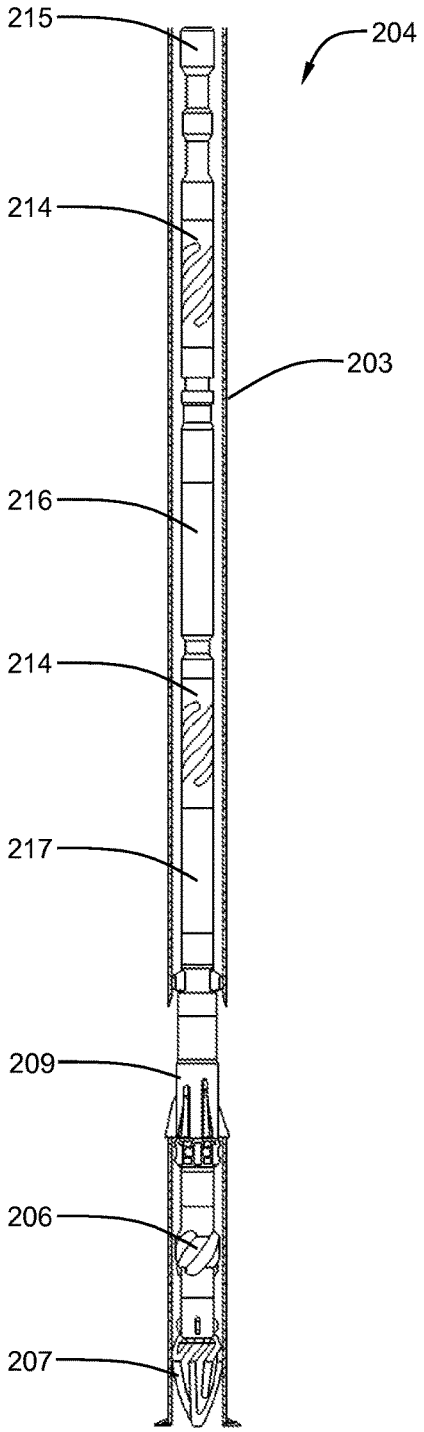
FIG. 2 is a partial side view of a bottomhole assembly for performing section milling, in accordance with one or more embodiments of the present disclosure.

FIG. 2 illustrates an example BHA 204 in more detail, in accordance with another embodiment of the present disclosure. The BHA 204 may be used in a wellbore within an earthen formation and used in a milling operation occurring, for instance, in a cased wellbore. The BHA 204 may include various components, including one or more mills, which in this embodiment includes at least one section mill 209 for milling a casing or liner (e.g., casing 203) within a wellbore. In some embodiments, the section mill 209 may be used to create a rock-to-rock opening within the casing. Such an opening may be used to facilitate setting a rock-to-rock cement plug for a well abandonment operation, to create a rock interface for drilling of a sidetracked lateral borehole, or for other operations. In other embodiments, the section mill 209 may be used to mill out an interior casing and expose an outer casing. Regardless of the particular use of the section mill 209, it may include one or more blades or knives, which may be selectively expanded and retracted. In the retracted position, the cutter arms may be in a radially inward position that allows run-in of the section mill 209 within the wellbore. Upon reaching a desired depth and milling location, the blades may be selectively expanded by moving them radially outward in response to hydraulic, electronic, wireless, mechanical, other actuation control, or any combination of the foregoing. The blades and any cutting inserts thereon may engage the casing 203 to initiate a cutout, and at the same time or thereafter be moved in an upward or downward direction to mill the casing 203. Upon completion of a milling operation, the blades can be retracted to allow for withdrawal of the section mill 209 from the wellbore.

The BHA 204 of FIG. 2 may also include any number of other components. For instance, the section mill 209 or another component of the BHA 204 may include a position indicator that provides a surface signal to notify an operator when the cutter arms are fully expanded. Other components of the BHA 204 of FIG. 2 may include, by way of illustration, stabilizers/centralizers 206 and/or a taper mill 207. The stabilizers/centralizers 206 and/or taper mill 207 may be run below the section mill 209 in some embodiments. In the same or other embodiments, one or more stabilizers/centralizers 206 may be located above the section mill 209, below the section mill 209, or both above and below the section mill 209. A taper or lead mill 207 may be positioned at the downhole end portion of the BHA 204, and may include a tapered mill head that can be used as a guide mill within the wellbore. Still other components of the BHA 204 may include drill collars 214 and/or heavyweight drill pipe 215. In some embodiments, one or more jars 216 or other shock tools may be used. Float subs 217 may also be used (e.g., above the section mill 209) and used to limit or prevent cuttings from entering the section mill 209 and/or blocking a piston orifice. As will be appreciated by those of ordinary skill in the art in view of the disclosure herein, the BHA 204 may also include still other or additional components. Indeed, in some embodiments, the BHA 204 may include multiple section mills 209. As an example, to extend the length of the casing 203 that may be milled, two or more section mills 209 may be included and may be separately activated to allow a first one of the section mills 209 (e.g., a lower section mill) to mill a first portion of the casing 203. The first section mill may then be deactivated and the second section mill (e.g., an upper section mill) may be lowered or otherwise moved to the milled-out region and activated to continue milling the casing 203.

Figure 3:
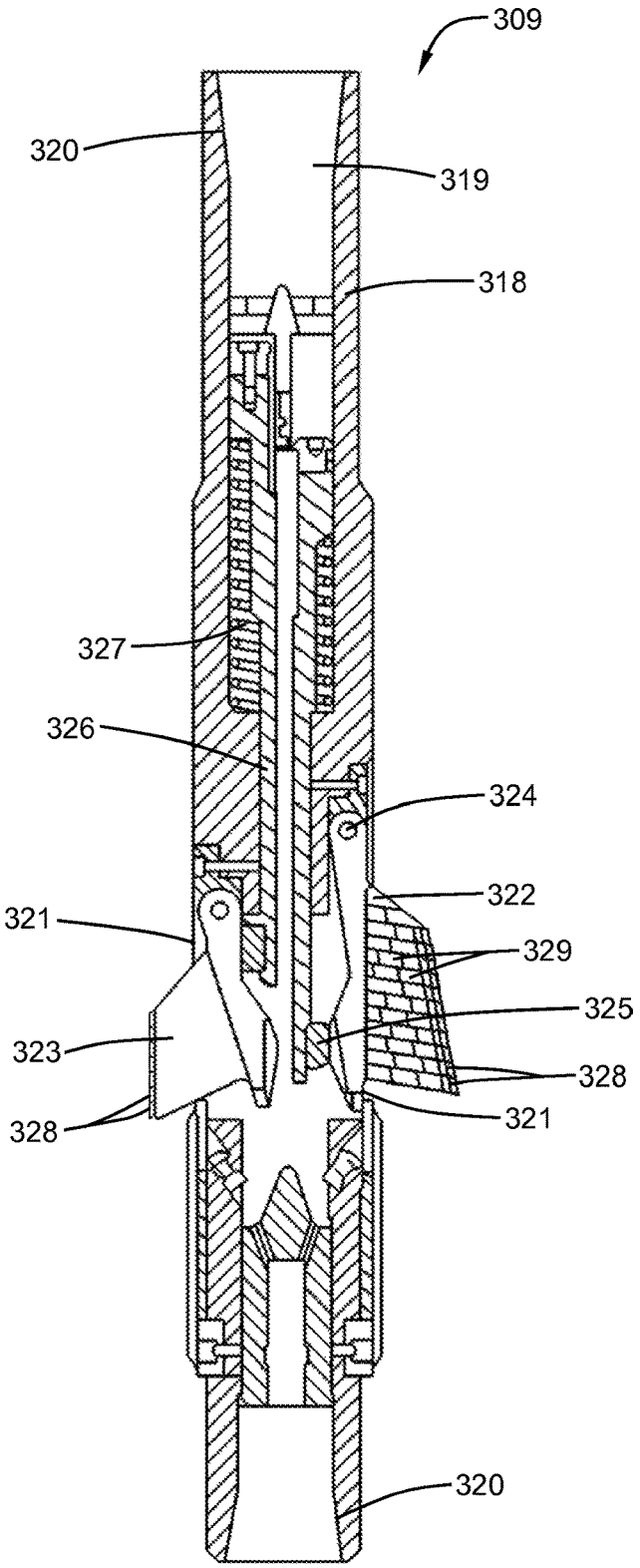
FIG. 3 is a cross-sectional view of an example section mill, in accordance with one or more embodiments of the present disclosure.

Turning now to FIG. 3, a particular example of a section mill 309 is shown and described in additional detail. The section mill 309 may have a body 318 having a bore 319 extending fully or partially along an axial length thereof. In some embodiments, one or both of the body 318 and the bore 319 may have a circular cross-sectional shape, and may allow for the circulation of fluid through the body 318. For instance, the body 318 may be tubular; however, the body 318 may have other structures, cross-sectional shapes, or other configurations. Optionally, the upper and/or lower end of the body 318 may have a connector 320 for connecting the body 318 to a drill string or components of a BHA or other downhole tool. In some embodiments, the connector 320 may include a threaded connector with a box or pin connection.

In accordance with some embodiments, one or more longitudinal slots 321 or other openings may be formed in, and extend axially along, the outer circumference or perimeter of the body 318. The number of slots 321 or other openings may be different for various embodiments. For instance, the body 318 may have between one (1) and twenty (20) slots 321 in some embodiments, and more particularly may have between three (3) and six (6), eight (8) or twelve (12) slots 321 in some embodiments. Of course, in other embodiments, a range of a number of slots 321 in the body 318 may begin and end anywhere between one (1) and twenty (20), although in other embodiments there may be more than twenty (20) slots 321.

Each slot 321 may be aligned with a movable blade 322, 323 that is coupled to the body 318. In the illustrated embodiment, the movable blades 322 may be axially longer than the movable blades 323. In some embodiments, the movable blades 322, 323 may alternate in a circumferential direction around the body 318. For instance, three (3) axially longer movable blades 322 may be interspaced by three (3) axially shorter movable blades 323 each mounted on a respective pivot 324 in each of the slots 321. A respective cam 325 may be carried or otherwise operated by a piston 326 that may move in response to fluid circulating within the body 318. The cams 325 may act on the movable blades 322, 323 so that the cutter is pivotally radially movable outward from a central axis of the body 318 to a cutting position. In FIG. 3, the movable blade 322 alone is shown in the radially extended, cutting position. The piston 326 may be biased by a compression spring 327. In operation, the section mill 309 may rotate about a longitudinal axis of the body 318.

The movable blades 322, 323 may include or be coupled to cutting inserts 328, 329 of any suitable type for use in a section milling operation. As shown in FIG. 3, the cutting inserts 328, 329 may be mounted on the front face of each movable blade 322, 323. In some embodiments, a bottom surface or face of each cutting insert 328, 329 may be welded or brazed to the front face or surface of each movable blade 322, 323. According to at least some embodiments, the cutting inserts 328, 329 may be arranged in an array of the cutting inserts 328, 329 extending radially and axially along the movable blades 322, 323. Each cutting insert 328, 329 may be adjacent one or more other cutting inserts 328, 329, and may optionally abut or contact adjacent cutting inserts 328, 329 along one or more front, rear, or side edges or faces.

In FIG. 3, the array may include the cutting inserts 328, 329 arranged in offset or staggered rows. For instance, the cutting inserts 328, 329 may have generally uniform widths and may be arranged and aligned in radial rows of generally uniform height. Each row may therefore be at a different axial or longitudinal position. The cutting inserts 328, 329 may then have different lengths, or be otherwise positioned so that the edge of one cutting insert 328, 329 may be out of alignment with, and radially offset or staggered from, an edge of a cutting insert 328, 329 in an axially adjacent row. Such an arrangement is, however, merely illustrative. In other embodiments, for instance, cutting inserts may be arranged in rows of differing heights, in columns, or in both columns and rows (i.e., without offsets or staggering). Moreover, in some embodiments, each cutting insert may be of a uniform size, although in other embodiments some cutting inserts may have different widths, heights, lengths, or other sizes. Additionally, while the cutting inserts 328, 329 are shown as being arranged in a generally regular pattern along about the full front face of the movable blade 322, other embodiments contemplate positioning the cutting inserts 328, 329 along less than a full portion of the front face or other cutting portion of the movable blade 322, or arranging the cutting inserts 328, 329 in a non-uniform or even random or pseudo-random pattern.

According to at least one embodiment, two or more different cutting inserts 328, 329 may be coupled to the movable blades 322, 323. In particular, first cutting inserts 328 may be a first cutting insert, or first type of cutting insert and may have one or more of a different shape, structure, material, form, or other configuration relative to second cutting inserts 329, which may be a second cutting insert or second type of cutting insert. As shown in FIG. 3, for instance, the first cutting inserts 328 may be aligned along the outer radial edge of the movable blades 322, 323, and may be different than the second cutting inserts 329 that may extend radially inward from the first cutting inserts 328. Accordingly, as the movable blades 322, 323 extend radially outwardly, the first cutting inserts 328 may initially make contact with a casing or other workpiece to be cut or milled by the section mill 309. As discussed herein, in at least some embodiments, the first cutting inserts 328 may be at least partially configured to cut a casing in a different manner than the second cutting inserts 329. For instance, the first cutting inserts 328 may include features configured or otherwise designed to operate as a turning tool, while the second cutting inserts may include features configured or otherwise designed to operate as a milling tool (e.g., a face milling tool). Turning tool features, which may more generally be described herein as turning portions, may be used, for instance, to cut or mill primarily in a radial direction. Thus, a turning portion may be specifically configured to cut in a turning fashion, whereas milling tool features may be to specifically designed, arranged, or otherwise configured to cut or mill primarily in an axial or longitudinal direction. Thus, in at least some embodiments, a first cutting insert 328 may be used and configured to initiate a cut-out in a casing by cutting/milling radially outward through a thickness of the casing, while a second cutting insert 329 may be used and configured to extend a length of the cut-out in the casing by cutting/milling along an axial or longitudinal length of the casing.

As discussed in greater detail herein, in at least some embodiments, the first cutting inserts 328 may include both turning and milling features, while in other embodiments the first cutting inserts 328 may include turning features but lack milling features. Additionally, while FIG. 3 illustrates an example in which the first cutting inserts 328 extend along an extended length, or even a full length, of the outer radial edge of the movable blades 322, 323, other embodiments contemplate placing the first cutting inserts 328 along lesser portions of the movable blades 322, 323. Also, as more easily seen in reference to movable blade 323 which shows a back or rear face thereof, some embodiments contemplate at least a portion of the first cutting inserts 328 extending radially outwardly from an outer radial edge of the movable blade 323. In other embodiments, however, the first cutting inserts 328 may be aligned with, or even radially inward relative to, an outer radial edge of the movable blades 322, 323.

The cutting inserts 328, 329 may be referred to herein as, or may include, cutting elements or milling inserts formed of any material suitable for milling casing within a wellbore. In an example embodiment, the casing may be made of steel and the cutting inserts 328, 329 may be formed of a material that can cut steel. Examples of suitable materials useful for cutting steel or other casing may include, by way of illustration, tungsten, titanium, ceramics, metal carbides (e.g., niobium carbide, tungsten carbide, cobalt-cemented tungsten carbide, titanium carbide, cemented titanium carbide, tantalum carbide, cemented tantalum carbide, vanadium carbide, molybdenum carbide), diamond (e.g., polycrystalline diamond), cubic boron nitride (e.g., polycrystalline cubic boron nitride), other so-called "superhard" or "superabrasive" materials, or any combination of the foregoing.

Figures 1, 4:
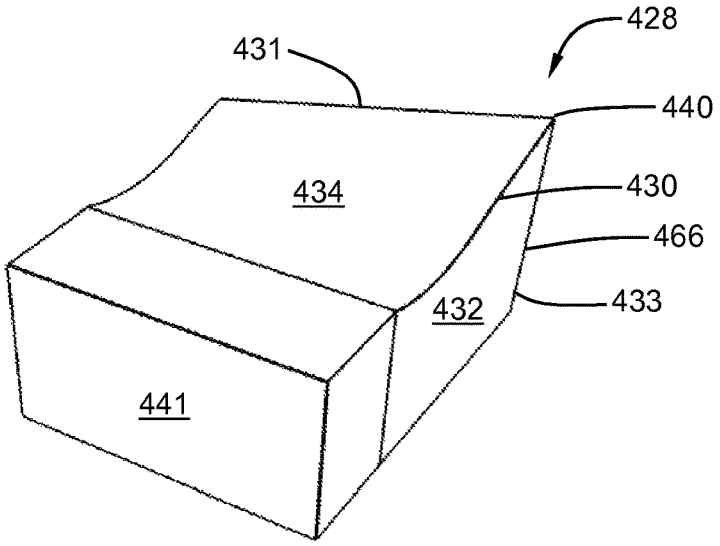
Figures 2, 4:
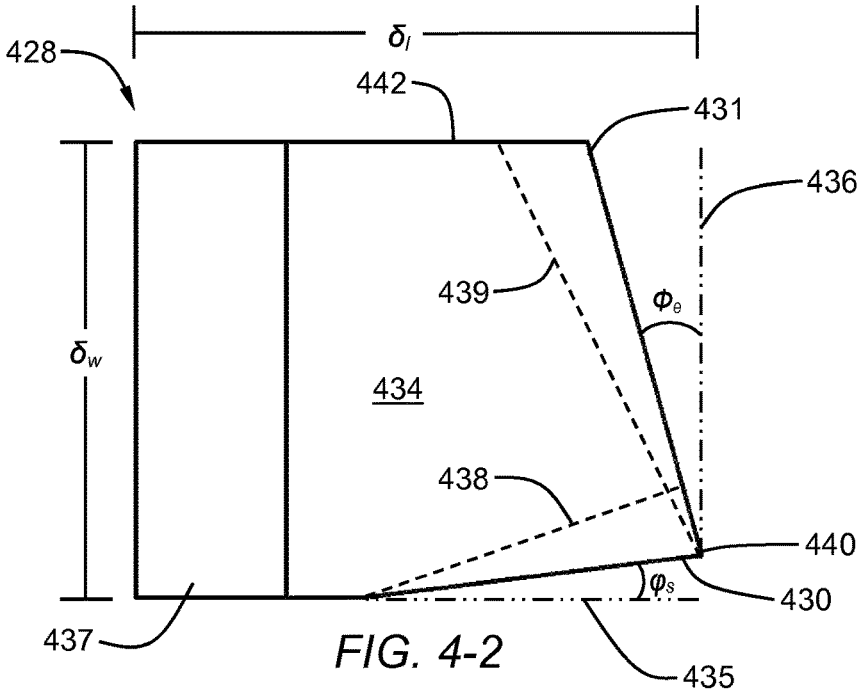
Figures 3, 4:
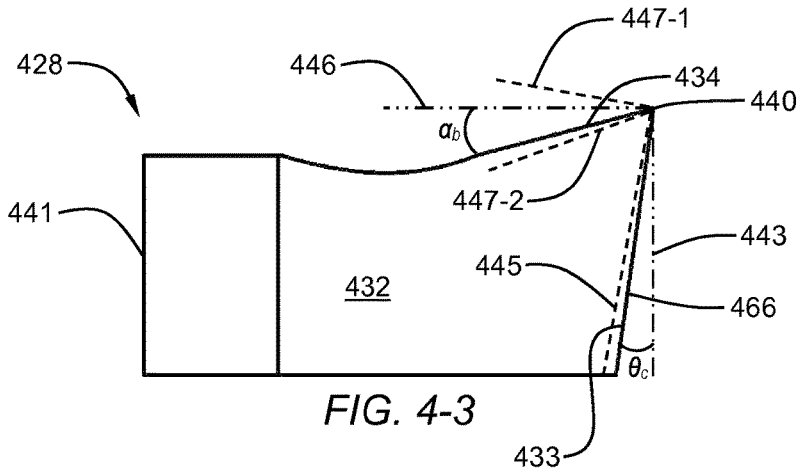
Figure 4:
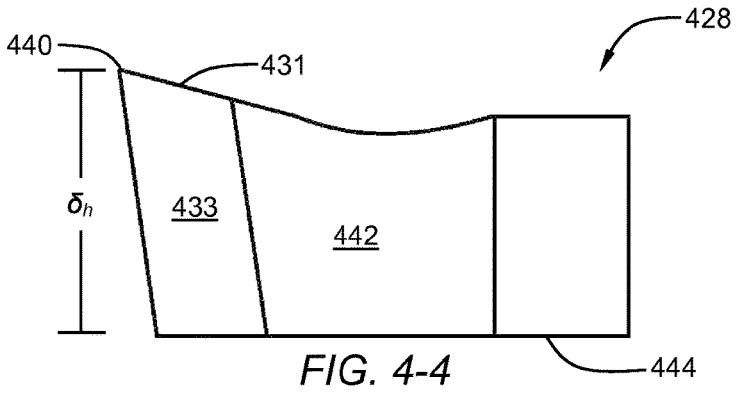

An example of a cutting insert 428 that may be used on a milling tool is illustrated in FIG. 4-1. The cutting insert 428 may include features configured or otherwise designed to allow the cutting insert 428 to operate as a turning tool. For instance, the cutting insert 428 may include one or more cutting edges 430, 431. In particular, the cutting insert 428 may include a side cutting edge 430. The side cutting edge 430 may be formed at an intersection of a front face 432 and a top face 434. When the cutting insert 428 is installed on a tool (e.g., movable blade 322 of FIG. 3), the cutting insert 428 may be oriented such that the side cutting edge 430 may act as a primary cutting edge to turn and cut the workpiece (e.g., casing) when the cutting insert 428 is rotated (e.g., about a longitudinal axis of the tool).

The cutting insert 428 may also include an end cutting edge 431. The end cutting edge 431 may be formed at an intersection of a first end face 433 and the top face 434. The end cutting edge 431 may act as a secondary cutting edge. In at least some embodiments, the end cutting edge 431 may cooperate with the side cutting edge 430 to turn and cut the workpiece when the cutting insert 428 is rotated. The use of multiple cutting edges is optional. In embodiments where multiple cutting edges are provided, however, the secondary cutting edge (e.g., end cutting edge 431) may provide a new cutting edge when the primary cutting edge (e.g., side cutting edge 430) cracks or wears. Additionally, in combination with other features of the cutting insert 428 (e.g., a back rake angle as discussed herein with reference to FIGS. 4-3 and 4-4), the end cutting edge 431, the first end face 433, or other features may operate as a chip breaker. In particular, as casing or another workpiece is cut by the cutting edges 430, 431 operating as a turning tool, tailing swarf from the workpiece may be broken up to form chips of a consistently small size and shape that can be efficiently handled and conveyed to the surface. In some cases, larger chips or swarf may wrap around tools or objects downhole and create a mass or "bird nest" which may obstruct the wellbore and/or be difficult to convey to the surface. The rate of penetration of the tool using the cutting insert 428 may also be rendered more consistent as a result of breaking swarf into smaller chips.

As discussed herein, the geometry of the cutting insert 428 may be structured or otherwise configured to facilitate use of the cutting insert 428 as a turning tool. Thus, when the cutting insert 428 is used as a turning tool by, for instance, engaging one or both of the cutting edges 430, 431 against a workpiece (e.g., an interior surface of casing) and rotating the cutting insert 428 (e.g., about a longitudinal axis of a BHA or milling tool), the workpiece may be cut in a turning or lathe-like fashion. The geometry of the cutting insert 428 may be varied or structured as desired to facilitate such an operation. FIG. 4-2 to FIG. 4-6 provide additional views of the cutting insert 428 of FIG. 4-1 to facilitate a discussion of examples of geometries that may be used by the cutting insert 428 to allow operation as a turning tool. It will be appreciated by those having ordinary skill in the art in view of the present disclosure that certain terminology and nomenclature may be used to describe dimensions of turning tools, but that other terminology and nomenclature could be used. In particular, terminology used in describing FIG. 4-2 to FIG. 4-6 may include terms common for describing turning tools, but which may have equivalent angles described in other manners for milling or other tools. For instance, the terms "side rake angle," "back rake angle," and "side cutting edge angle" may be commonly used in describing turning tools, and may be generally equivalent to terms such as "radial rake angle," axial rake angle," or "corner angle" in face-milling nomenclature.

More particularly, FIG. 4-2 is a top view of the cutting insert 428 of FIG. 4-1. In this particular view, the side cutting edge 430 and the end cutting edge 431 are illustrated and shown as being angled relative to reference lines 435, 436, respectively. In the illustrated embodiment, the reference line 435 is shown as being horizontal while the reference line 436 is shown as being vertical; however, these orientations are merely illustrative. In some embodiments, the reference lines 435, 436 may be perpendicular relative to each other, and may also extend from, along, or be parallel to other features of the cutting insert 428, regardless of the particular orientation. For instance, the cutting insert 428 may include a shank 437. Optionally, the shank 437 may be rectangular and the reference lines 435, 436 may extend about parallel to corresponding edges or surfaces of the shank 437. Some of the turning tool features of the cutting insert 428 may be measured with reference to the reference lines 435, 436. In other embodiments, however, turning tool features may be measured in other manners. For instance, features of the turning tool may be measured by using the side cutting edge 430 or the end cutting edge 431 as a reference.

In the view shown in FIG. 4-2, various angles, features, and geometries of the cutting insert 428 are illustrated. For instance, the cutting insert 428 is shown as having a side cutting edge angle $\varphi_s$ defined as the angle between the side cutting edge 430 and the reference line 435. The cutting insert 428 is also shown as having an end cutting edge angle $\varphi_e$ which is defined as the angle between the end cutting edge 431 and the reference line 436.

According to the present disclosure, the magnitude of the side and end cutting edge angles $\varphi_s$ and $\varphi_e$ may be different in various embodiments based on any number of factors, including the type of workpiece being cut (e.g., steel casing), the type of materials used in the cutting insert 428 (e.g., tungsten carbide), the expected depth of cut, the expected rotational speed of a downhole tool, rate of milling, and the like. In accordance with at least some embodiments, the side cutting edge angle $\varphi_s$ may be between 0° and 45°, or more particularly between 0° and 20°. In FIG. 4-2, the range of the side cutting edge angle $\varphi_s$ between 0° and 20° is shown as being between the reference line 435 (i.e., side cutting edge angle $\varphi_s$=0°) and the dashed line 438 (i.e., side cutting edge angle $\varphi_s$=20°). In still other embodiments, the side cutting edge angle $\varphi_s$ may be within a range having lower and/or upper limits that include any of 0°, 0.5°, 1°, 1.5°, 2°, 2.5°, 3°, 5°, 7.5°, 10°, 15°, 20°, 30°, 45°, and any values therebetween. For instance, the side cutting edge angle $\varphi_s$ may be between 0° and 5°, between 0° and 2°, between 0° and 1°, between 0.5° and 1.5°, between 1° and 20°, or between 10° and 20°. In still other embodiments, the side cutting edge angle $\varphi_s$ may be larger than 45° or less than 0° (i.e., negative).

A variety of different end cutting edge angles $\varphi_e$ may also be used in various embodiments, and in at least some embodiments the end cutting edge angle $\varphi_e$ may be between 0° and 45°, or more particularly between 0° and 20°. In FIG. 4-2, the range of the end cutting edge angle $\varphi_e$ between 0° and 20° is shown as being between the reference line 436 (i.e., end cutting edge angle $\varphi_e$=0°) and the dashed example end cutting edge line 439 (i.e., end cutting edge angle $\varphi_e$=20°). In still other embodiments, the end cutting edge angle $\varphi_e$ may be within a range having lower and/or upper limits that include any of 0°, 2°, 4°, 4.5°, 5°, 5.5°, 6°, 7°, 8°, 10°, 15°, 20°, 300°, 45°, and any values therebetween. For instance, end cutting edge angle $\varphi_e$ may be between 0° and 10°, between 0° and 5°, between 2° and 8°, between 4° and 6°, between 4.5° and 5.5°, between 5° and 15°, between 5° and 20°, or between 10° and 20°. In still other embodiments, the end cutting edge angle $\varphi_e$ may be larger than 45° or less than 0° (i.e., negative).

The cutting insert 428 may also have any number of other dimensions or features that may be identified when the cutting insert 428 is viewed in profile as shown in FIG. 4-2. A length $\delta_l$ of the cutting insert 428 may, for instance, be measured as a distance between a nose 440 of the cutting insert 428 and a second end face 441 (see FIG. 4-1) of the shank 437. The nose 440 may be formed at the junction or intersection between the side cutting edge 430 and the end cutting edge 431 (and potentially along the intersection of the front face 432 and the first end face 433). In some embodiments, the nose 440 may have a radius. For instance, the radius of the nose 440 may be between 1/32 inch (0.8 mm) and 1/2 inch (12.7 mm) in some embodiments. More particularly, some embodiments may include a cutting insert 428 having a nose 440 with a radius within a range having lower and/or upper limits that include any of 1/32 inch (0.8 mm), 1/16 inch (1.6 mm), 1/8 inch (3.2 mm), 3/16 inch (4.8 mm), 1/4 inch (6.4 mm), 3/8 inch (9.5 mm), 1/2 inch (12.7 mm), and any values therebetween. For instance, the nose 440 may have a radius between 1/16 inch (1.6 mm) and 3/16 inch (4.8 mm). In other embodiments, the radius of the nose 440 may be less than 1/32 inch (0.8 mm) or greater than 1/2 inch (12.7 mm).

The cutting insert 428 may also have width $\delta_w$ as measured as a distance between the reference line 435 (which may correspond to a portion of the front face 432 of FIG. 4-1) and a rear face 442. In at least some embodiments, one or both of the length $\delta_l$ and width $\delta_w$ may not be constant. For instance, the illustrated length $\delta_l$ and width $\delta_w$ may be a maximum length and a maximum width; however, the actual length at any position along the width of the cutting insert 428, or the actual width at any position along the length of the cutting insert 428, may be less than the corresponding length $\delta_l$ and width $\delta_w$ shown in FIG. 4-2.

The length $\delta_l$ and width $\delta_w$ may be varied depending on a variety of factors, including the size of the downhole tool, the size of the blade of the downhole tool, the type of workpiece material being turned, the amount of overhang of the cutting insert 428 relative to the blade (as discussed in more detail herein), the amount of surface area contact between a bottom surface of the cutting insert 428 and the blade, or any other of myriad factors. In accordance with at least some embodiments, the length $\delta_l$ may be between 1/8 inch (3.0 mm) and 3 inches (76.0 mm). More particularly, some embodiments may include a cutting insert 428 having a length $\delta_l$ within a range having lower and/or upper limits that include any of 1/8 inch (3.0 mm), 1/4 inch (6.5 mm), 3/8 inch (9.5 mm), 1/2 inch (12.5 mm), 5/8 inch (16.0 mm), 3/4 inch (19.0 mm), 7/8 inch (22.0 mm), 1 inch (25.5 mm), 1 1/4 inches (32.0 mm), 1 1/2 inches (38.0 mm), 1 3/4 inches (43.0 mm), 2 inches (51.0 mm), 2 1/4 inches (57.0 mm), 2 1/2 inches (63.5 mm), 2 3/4 inches (70.0 mm), 3 inches (76.0 mm), and any values therebetween. For instance, the length $\delta_l$ may be between 1/4 inch (6.5 mm) and 1 inch (25.5 mm), between 3/8 inch (9.5 mm) and 1 inch (25.5 mm), between 1/4 inch (6.5 mm) and 3/4 inch (19.0 mm), between 3/8 inch (9.5 mm) and 3/4 inch (19.0 mm), or between 1/2 inch (12.5 mm) and 1 1/2 inch (38.0 mm). In still other embodiments, the length $\delta_l$ may be larger than 3 inches (76.0 mm) or less than 1/8 inch (3.0 mm).

In a similar manner, the width $\delta_w$ may also be different in various embodiments, and in some embodiments may be between 1/16 inch (1.5 mm) and 1 inch (25.5 mm). More particularly, embodiments of a cutting insert 428 may have a width $\delta_w$ within a range having lower and/or upper limits that include any of 1/16 inch (1.5 mm), 1/8 inch (3.0 mm), 3/16 inch (5.0 mm), 1/4 inch (6.5 mm), 5/16 inch (8.0 mm), 3/8 inch (9.5 mm), 7/16 inch (11.0 mm), 1/2 inch (12.5 mm), 9/16 inch (14.5 mm), 5/8 inch (16.0 mm), 11/16 inch (17.5 mm), 3/4 inch (19.0 mm), 13/16 inch (20.5 mm), 7/8 inch (22.0 mm), 15/16 inch (24.0 mm), 1 inch (25.5 mm), and any values therebetween. For instance, the width $\delta_w$ may be between 1/16 inch (1.5 mm) and 3/8 inch (9.5 mm), between 1/8 inch (3.0 mm) and 1/2 inch (12.5 mm), between 1/4 inch (6.5 mm) and 3/4 inch (19.0 mm), between 1/4 inch (6.5 mm) and 1/2 inch (12.5 mm), between 5/16 inch (8.0 mm) and 11/16 inch (17.5 mm), or between 3/8 inch (9.5 mm) and 1 inch (25.5 mm). In still other embodiments, the width $\delta_w$ may be larger than 1 inch (25.5 mm) or less than 1/16 inch (1.5 mm).

FIGS. 4-3 and 4-4 show side, profile views as taken from the front face 432 and the rear face 442, respectively, of the cutting insert 428 of FIGS. 4-1 and 4-2. From the illustrated side, profile views, additional geometric features of the cutting insert 428 may be seen. For instance, the front face 432 may be angled relative to a reference line 443, which is shown as being vertical and which is optionally parallel to the second end face 441 or perpendicular to the bottom face 444 of the cutting insert 428. A front edge 466 may be formed at an intersection of the front face 432 and the first end face 433. The angle between the front edge 466 and the reference line 443, as seen in the profile view of FIG. 4-3, may be referred to as the end relief angle $\theta_c$.

According to the present disclosure, the magnitude of the end relief angle $\theta_c$ may be different in various embodiments based on a variety of factors, including those identified in this disclosure. In accordance with at least some embodiments, the end relief angle $\theta_c$ may be between 0° and 20°, or more particularly between 0° and 10°. In FIG. 4-3, the range of the end relief angle $\theta_c$ between 0° and 10° is shown as being between the reference line 443 (i.e., end relief angle $\theta_c$=0°) and the dashed line 445 (i.e., end relief angle $\theta_c$=10°). In still other embodiments, the end relief angle $\theta_c$ may be within a range having lower and/or upper limits that include any of 0°, 0.5°, 1°, 1.5°, 2°, 2.5°, 3°, 3.5°, 5°, 7.5°, 10°, 12.5°, 15°, 20°, and any values therebetween. For instance, the end relief angle $\theta_c$ may be between 0° and 5°, between 0° and 7.5°, between 0° and 2°, between 1° and 5°, between 1° and 3°, between 1.5° and 2.5°, between 5° and 10°, or between 2° and 10°. In still other embodiments, the end relief angle $\theta_c$ may be larger than 20° or less than 0° (i.e., negative).

As also shown in the side, profile views of FIGS. 4-3 and 4-4, the top face 434 may be angled relative to a reference line 446, which is shown as being horizontal, and which is optionally parallel to the bottom face 444 or perpendicular to the rear face 442 of the cutting insert 428. The angle between the side cutting edge 430 and the reference line 446, as seen in the profile view of FIG. 4-3, may be referred to as the back rake angle $\alpha_b$.

According to the present disclosure, the magnitude of the back rake angle $\alpha_b$ may be different in various embodiments based on a variety of factors, including those identified in this disclosure. In accordance with at least some embodiments, the back rake angle $\alpha_b$ may be between −20° and 40°, or more particularly between −10° and 20°. In FIG. 4-3, the range of the back rake angle $\alpha_b$ between −10° and 20° is shown as being between the dashed line 447-1 (i.e., back rake angle $\alpha_b$=−10° and the dashed line 447-2 (i.e., back rake angle $\alpha_b$=20°). In still other embodiments, the back rake angle $\alpha_b$ may be within a range having lower and/or upper limits that include any of −20°, −15°, −10°, −7.5°, −5°, −4°, −3°, −2°, −1°, 0°, 1°, 2°, 3°, 4°, 4.5°, 5°, 5.5°, 6°, 7°, 7.5°, 8°, 10°, 12.5°, 15°, 20°, 25°, 30°, 40°, and any values therebetween. For instance, the back rake angle $\alpha_b$ may be between −5° and 10°, between −10° and 5°, between 0° and 7.5°, between 2° and 8°, between 4° and 6°, between 4.5° and 5.5°, between 5° and 10°, or between 5° and 20°. In still other embodiments, the back rake angle $\alpha_b$ may be larger than 40° or less than −10°. In at least some embodiments, the back rake angle $\alpha_b$ may be a composite back rake angle made up of primary and secondary back rake angles. For instance, the side cutting edge 430 may have multiple sections, each potentially having a different angle relative to the reference line 446. A composite back rake angle may be defined by the multiple sections of the side cutting edge 430.

The cutting insert 428 may also have other dimensions or features that may be identified when the cutting insert 428 is viewed in profile as shown in FIGS. 4-3 and 4-4. A height $\delta_h$ of the cutting insert 428 may, for instance, be measured as a distance between a nose 440 of the cutting insert 428 and a bottom face 444, as seen in FIG. 4-4. In at least some embodiments, the height $\delta_h$ may not be constant. For instance, the illustrated height $\delta_h$ may be a maximum height; however, the actual height at any position along the length or width of the cutting insert 428 may be less than the corresponding height $\delta_h$ shown in FIG. 4-4.

The particular height $\delta_h$ of various embodiments of the present disclosure may be varied on depending on a variety of factors, including factors identified herein. In accordance with at least some embodiments, the height $\delta_h$ may be between 1/16 inch (1.5 mm) and 1 inch (25.5 mm). More particularly, embodiments of a cutting insert 428 may have a height $\delta_h$ within a range having lower and/or upper limits that include any of 1/16 inch (1.5 mm), 1/8 inch (3.0 mm), 3/16 inch (5.0 mm), 1/4 inch (6.5 mm), 5/16 inch (8.0 mm), 3/8 inch (9.5 mm), 7/16 inch (11.0 mm), 1/2 inch (12.5 mm), 9/16 inch (14.5 mm), 5/8 inch (16.0 mm), 11/16 inch (17.5 mm), 3/4 inch (19.0 mm), 13/16 inch (20.5 mm), 7/8 inch (22.0 mm), 15/16 inch (24.0 mm), 1 inch (25.5 mm), and any values therebetween. For instance, the height $\delta_h$ may be between 1/16 inch (1.5 mm) and 3/8 inch (9.5 mm), between 1/8 inch (3.0 mm) and 1/4 inch (6.5 mm), between 1/4 inch (6.5 mm) and 3/4 inch (19.0 mm), between 1/4 inch (6.5 mm) and 1/2 inch (12.5 mm), between 5/16 inch (8.0 mm) and 11/16 inch (17.5 mm), or between 1/4 inch (9.5 mm) and 1 inch (25.5 mm). In still other embodiments, the height $\delta_h$ may be larger than 1 inch (25.5 mm) or less than 1/16 inch (1.5 mm).

Figures 4, 5:
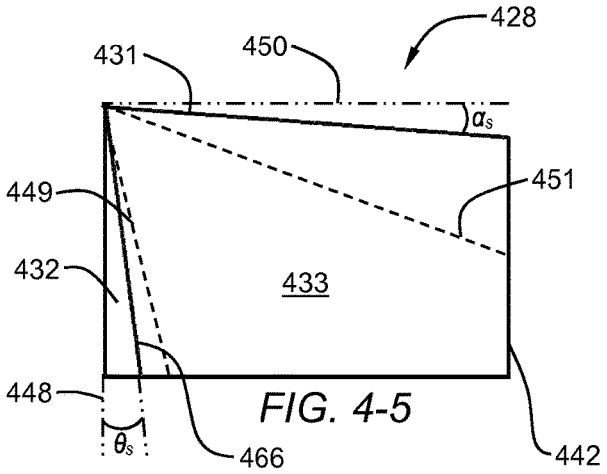
Figures 4, 5, 6:
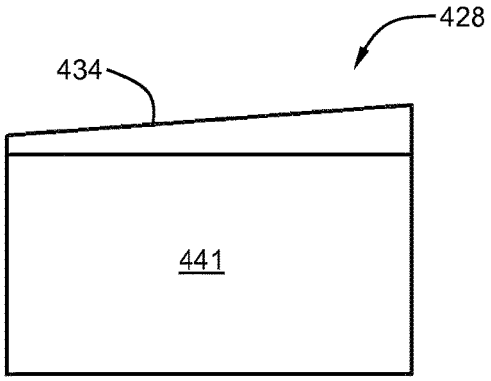
Figures 1, 5:
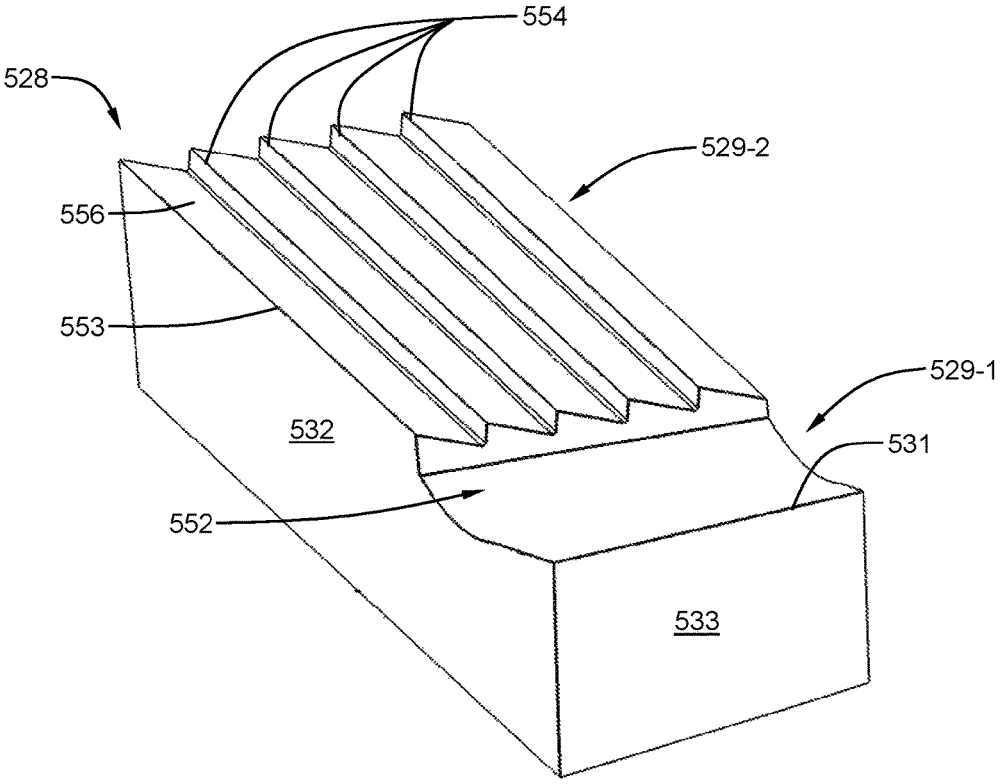
Figures 2, 5:
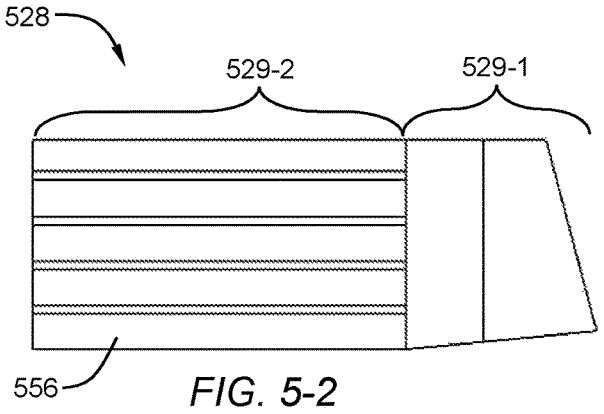
Figures 3, 5:
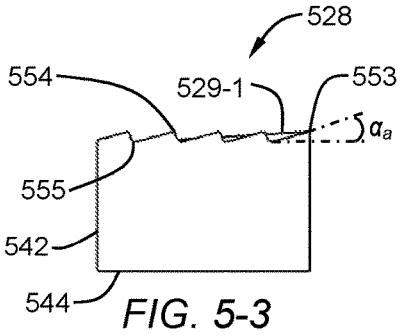
Figure 6:
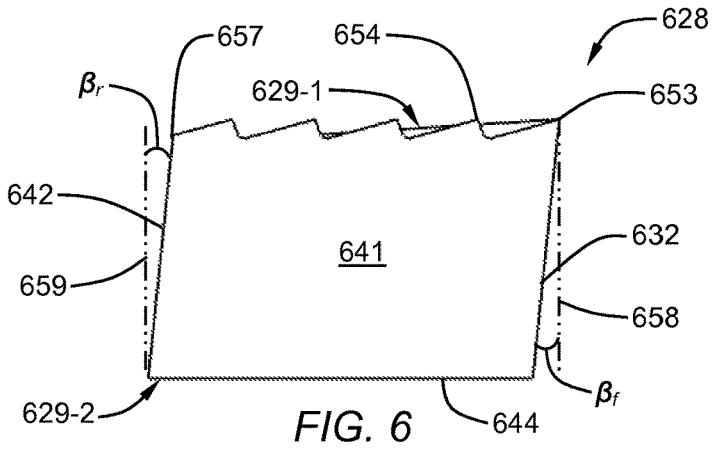

FIGS. 4-5 and 4-6 show side, profile views as viewed from the first and second end faces 433, 441, respectively, of the cutting insert 428 of FIGS. 4-1 and 4-2. From the illustrated side, profile views, additional geometric features of the cutting insert 428 may be seen. For instance, the front face 432 may be angled relative to a reference line 448. In the illustrated embodiment, the reference line 448 is shown as being vertical, but it may be horizontal or inclined based on the particular orientation of the cutting insert 428. In some embodiments, the reference line 448 and may be perpendicular to the bottom face 444 of the cutting insert 428, parallel to the rear face 442, parallel to a front face of the shank 437, or some combination of the foregoing. The angle between the front edge 466 and the reference line 448, as seen in the profile view of FIG. 4-5, may be referred to as the side relief angle $\theta_s$.

According to the present disclosure, the magnitude of the side relief angle $\theta_s$ may be different in various embodiments based on a variety of factors, including those identified in this disclosure. In accordance with at least some embodiments, the side relief angle $\theta_s$ may be between 0° and 20°, or more particularly between 0° and 10°. In FIG. 4-5, the range of the side relief angle $\theta_s$ between 0° and 10° is shown as being between the reference line 448 (i.e., side relief angle $\theta_s$=0°) and the dashed line 449 (i.e., side relief angle $\theta_s$=10°). In still other embodiments, the side relief angle $\theta_s$ may be within a range having lower and/or upper limits that include any of 0°, 0.5°, 1°, 1.5°, 2°, 2.5°, 3°, 3.5°, 5°, 7.5°, 10°, 12.5°, 15°, 20°, and any values therebetween. For instance, the side relief angle $\theta_s$ may be between 0° and 7.5°, between 0° and 2°, between 1° and 5°, between 1° and 3°, between 1.5° and 2.5°, between 5° and 10°, or between 2° and 10°. In still other embodiments, the side relief angle $\theta_s$ may be larger than 20° or less than 0° (i.e., negative).

As also shown in the side, profile views of FIGS. 4-5 and 4-6, the top face 434 may be angled relative to a reference line 450, which is shown as being horizontal, and which is optionally parallel to the bottom face 444, perpendicular to the rear face 442, perpendicular to the front or rear face of the shank 437 of the cutting insert 428, or some combination of the foregoing. The angle between the end cutting edge 431 and the reference line 450, as seen in the profile view of FIG. 4-5, may be referred to as the side rake angle $\alpha_s$.

According to the present disclosure, the magnitude of the side rake angle $\alpha_s$ may be different in various embodiments based on a variety of factors, including those identified in this disclosure. In accordance with at least some embodiments, the side rake angle $\alpha_s$ may be between 0° and 45°, or more particularly between 0° and 20°. In FIG. 4-5, the range of the side rake angle $\alpha_s$ between 0° and 20° is shown as being between the reference line 450 (i.e., side rake angle $\alpha_s$=0°) and the dashed line 451 (i.e., side rake angle $\alpha_s$=20°). In still other embodiments, the side rake angle $\alpha_s$ may be within a range having lower and/or upper limits that include any of 0°, 2°, 4°, 4.5°, 5°, 5.5°, 6°, 7°, 8°, 10°, 15°, 20°, 30°, 45°, and any values therebetween. For instance, the side rake angle $\alpha_s$ may be between 0° and 10°, between 0° and 5°, between 2° and 8°, between 4° and 6°, between 4.5° and 5.5°, between 5° and 15°, between 5° and 20°, between 10° and 20°, or between 20° and 45°. In still other embodiments, the side rake angle $\alpha_s$ may be larger than 45° or less than 0° (i.e., negative). In at least some embodiments, the side rake angle $\alpha_s$ may be a composite side rake angle made up of primary and secondary side rake angles (e.g., the end cutting edge 431 may have different sections or portions of varying angles relative to the reference line 450).

A cutting insert such as the cutting insert 428 shown in, or described relative to, FIGS. 4-1 to 4-6 may be used in any number of manners, including in connection with a milling tool as described herein (see, e.g., FIGS. 1 to 3 and FIGS. 12-1 to 16). In at least some embodiments, the cutting insert 428 may be used at a portion of the milling tool that first engages the wellbore and allows the cutting insert 428 to initiate a cutout by operating as a turning tool. The milling tool may further be used to mill the casing in an axial or longitudinal direction during a face milling operation. One or more additional cutters configured to perform face milling may also be included on the milling tool to facilitate such an operation.

In other embodiments, however, a cutting insert may include features configured to perform both turning (e.g., for initiating a cutout) and milling (e.g., for face milling) operations on a casing or other workpiece. An example cutting insert 528 having portions configured for different uses is shown in detail in FIGS. 5-1 to 5-3. As shown, the cutting insert 528 may include a turning portion 529-1 and a milling portion 529-2. The milling portion 529-2 and the turning portion 529-1 may be formed as an integral, monolithic piece, or may be joined together in any suitable manner. In some embodiments, the milling portion 529-2 may be configured for use in a face milling operation to mill axially or longitudinally along a workpiece, while the turning portion 529-1 may be configured for use in a turning operation to mill radially into a workpiece. As discussed herein, in other embodiments, the milling portion 529-2 may be separate from the turning portion 529-1 and thus form separate cutting inserts.

The turning portion 529-1 of the cutting insert 528 may be formed of any suitable materials and may have geometric or other properties to facilitate use of the cutting insert 528 to perform a turning operation (e.g., initiating a cutout in casing). In at least some embodiments, the turning portion 529-1 may have the same geometric properties as described herein with respect to the cutting insert 428 of FIGS. 4-1 to 4-6. For instance, the turning portion 529-1 may have back and side rake angles, side and end relief angles, and side and end cutting edge angles similar to, or the same as, those described herein. The turning portion 529-1 may also have the same or similar length, width, or height dimensions. In some embodiments, however, the shank 437 of the cutting insert 428 may be replaced by the milling portion 529-2, or by a transition portion 552 that couples the turning portion 529-1 to the milling portion 529-2. In other embodiments, a shank may be included along with a transition portion 552, a milling portion 529-2, or both.

The milling portion 529-2 of the cutting insert 528 may include a cutting edge 553 configured to engage the workpiece and mill axially along a length of the workpiece. In at least some embodiments, the milling portion 529-2 may also include one or more ridges 554 protruding from a body of the milling portion 529-2. The cutting edge 553 and the one or more ridges 554 may extend along a full or partial length of the milling portion 529-2, and may be spaced apart from each adjacent cutting edge 553 or ridge 554 (e.g., spaced along the width of the cutting insert 529). A recess 555 may be formed between each adjacent cutting edge 553 or ridge 554 to form a series of teeth. The surface between the cutting edge 553 and the adjacent recess 555 may be referred to herein as a rake face 556. In the illustrated embodiment, a cutting edge 553, four (4) ridges 554, and four (4) recesses 555 are illustrated; however, such numbers are merely illustrative. In other embodiments, different numbers of ridges or recesses may be provided (see, e.g., FIGS. 7-10).

As seen in the side profile view of FIG. 5-3, the cutting edge 553 of the cutting insert 528 may define an axial rake angle $\alpha_a$ measured between the rake face 556 and a line parallel to the bottom face 544. In some embodiments, the axial rake angle $\alpha_a$ may be between 0° and 30°. In still other embodiments, the axial rake angle $\alpha_a$ may be within a range having lower and/or upper limits that include any of 0°, 2.5°, 5°, 7.5°, 10°, 12.5°, 15°, 17.5°, 20°, 22.5°, 25°, 27.5°, 30°, and any values therebetween. For instance, the axial rake angle $\alpha_a$ may be between 0° and 20°, between 5° and 20°, between 10° and 20°, between 7.5° and 25°, between 5° and 30°, between 5° and 15°, between 17.5° and 22.5°, or between 2.5° and 25°. In still other embodiments, the axial rake angle $\alpha_a$ may be larger than 30° or less than 0° (i.e., negative).

In at least some embodiments, the ridges 554 may act as back-up cutting edges. In particular, as the cutting edge 553 is used to mill a workpiece, it may gradually be work back along the rake face 556 toward the adjacent ridge 554. The ridge 554 may then act as a cutting edge when the rake face 556 is completely worn down.

The recesses 555 may have a lowermost portion offset from the ridges 554 by any suitable distance. In the orientation shown in FIG. 5-3, the vertical distance may be referred to as a drop distance. The drop distance may be varied in various embodiments and, in at least some embodiments, may be based on the dimensions of the cutting insert 528, including the height of the cutting insert 528, the axial rake angle $\alpha_a$, the number of ridges 554, the shape of the rake face 556, and the like. The drop distance may, for instance, be larger where the axial rake angle $\alpha_a$ is larger, where there are fewer ridges 554, or where the cutting insert 528 is thicker and has a larger height. In some embodiments, the drop distance may be between 0% and 60% of the height of the cutting insert 528. In still other embodiments, the drop distance as a percentage of the height of the cutting insert 528 may be within a range having lower and/or upper limits that include any of 0%, 5%, 7.5%, 10%, 12.5%, 15%, 17.5%, 20%, 22.5%, 25%, 27.5%, 30%, 35%, 40%, 42.5%, 45%, 50%, 60%, and any values therebetween. For instance, the drop distance as a percentage of height of the cutting insert 528 may be between 7.5% and 10%, between 10% and 12.5%, between 15% and 17.5%, between 22.5% and 25%, or between 5% and 30%. In still other embodiments, the drop distance may be larger than 60% of the height of the cutting insert 528.

The dimensions of a cutting insert 528 including the turning portion 529-1 and the milling portion 529-2 may be different in various embodiments. As with the cutting insert 428 of FIGS. 4-1 to 4-6, for example, a width of the cutting insert 528 may be between 1/16 inch (1.5 mm) and 1 inch (25.5 mm), a height or thickness of the cutting insert 528 may be between 1/16 inch (1.5 mm) and 1 inch (25.5 mm), or a length of the cutting insert 528 may be between 1/8 inch (3.0 mm) and 3 inches (76.0 mm).

The turning portion 529-1 and the milling portion 529-2 may also have equal or unequal lengths. As also shown in FIG. 5-2, for example, the turning portion 529-1 may be shorter than the milling portion 529-2. In other embodiments, however, the relationship may be reversed. In at least some embodiments, a ratio of the length of the turning portion 529-1 to a length of the milling portion 529-2 may be between 1:10 and 10:1. In at least some embodiments, the ratio of the length of the turning portion 529-1 to a length of the milling portion 529-2 may be within a range having lower and/or upper limits that include any of 1:10, 1:8, 1:6, 1:4, 1:3, 1:2, 1:1, 2:1, 3:1, 4:1, 6:1, 8:1, 10:1, and any values therebetween. For instance, the ratio of the length of the turning portion 529-1 to the length of the milling portion 529-2 may be between 1:3 and 1:1, between 1:4 and 2:1, or between 1:6 and 4:1. In still other embodiments, the ratio may be larger than 10:1 or less than 1:10.

The cutting insert 528 has been described in relation to including a turning portion 529-1 and a milling portion 529-2; however, the cutting insert 528 (and other cutting inserts described herein) may be described in other terms. For instance, the turning portion 529-1 may include any structure configured to facilitate initiation of a cutout. Thus, the turning portion 529-1 may also be referred to as a cutout initiation portion. A cutout initiation portion may include turning, gouging, or other features that facilitate cutout initiation. The milling portion 529-2 may be referred to as a face milling or section milling portion as it facilitates milling in an axial direction. In another context, the turning portion 529-1 may be a first portion arranged, designed, or otherwise configured to cut a workpiece in one manner or direction (e.g., by turning, cutting, or shear action in a radial direction) and the milling portion 529-2 may be a second portion arranged, designed, or otherwise configured to cut a workpiece in a different manner or direction (e.g., by face milling or grinding action in an axial direction). In some embodiments, chip breaking may be performed as part of a first cutting mode (e.g., cutout initiation), a second cutting mode (e.g., face milling), or both first and second cutting modes.

In the embodiment illustrated in FIGS. 5-1 to 5-3, the front face 532 and rear face 542 are shown as being parallel to each other and perpendicular to the bottom face 544. In other embodiments, however, a cutting insert may include an angled/inclined front face or rear face. FIG. 6, for instance, is a side, profile view of a cutting insert 628 as viewed from a second end face 641. In at least some embodiments, the cutting insert 628 may include both a turning portion 629-1 and a milling portion 629-2.

The cutting insert 628 may include a flank face and a trailing face. In this particular embodiment, the flank face may include a front face 632 of the cutting insert 628, and the trailing face may include a rear face 642 opposite the front face 632. The front face 632 and the rear face 642 may each extend between the turning portion 629-1 and the second end face 641. A top face may also extend between the turning portion 629-1 and the second end face 641, and between the front face 632 and the rear face 642. A cutting edge 653 may be formed along an intersection of the top face and the front face 632. A trailing edge 657 may be formed along an intersection of the top face and the rear face 642. In some embodiments, the top face may have ridges 654, recesses, teeth, reliefs, contours, other features, or some combination of the foregoing.

Each cutting insert 628 may have a bottom face 644 opposite the top face. The bottom face 644 may be coupled to the milling or other cutting tool (see FIG. 3). For instance, the cutting inserts 628 may be coupled to, or otherwise disposed on, a blade or other portion of a downhole tool such that the cutting edge 653 may be at the lowest axial point of the cutting insert 628. A width of the cutting insert 628 may be measured between the cutting edge 653 and the trailing edge 657, or as the greatest distance between the front face 632 and the rear face 642.

The cutting insert 628 may also define a front flank angle $\beta_f$. In some embodiments, the front flank angle $\beta_f$ may be measured between the front face 632 and a reference line 658. The reference line 658 in the illustrated embodiment may be perpendicular to the bottom face 644 of the cutting insert 628, although in the same or other embodiments the reference line 658 may be perpendicular to a longitudinal axis of a downhole cutting or milling tool and/or a wellbore.

Further, the reference line 658 is optionally parallel with the rear face 642 of the cutting insert 628, such that the front flank angle $\beta_f$ may be equal to an angle measured between the front face 632 and a line parallel to the rear face 642. According to other embodiments, however, the rear face 642 of a cutting insert 628 may not be perpendicular to the bottom face 644 of the cutting insert 628 or to a line perpendicular to the longitudinal axis of the downhole cutting tool or wellbore. In such an embodiment, cutting insert 628 may define a rear flank angle $\beta_r$ between the rear face 642 and a reference line 659. The reference line 659 in the illustrated embodiment may be perpendicular to the bottom face 644 of the cutting insert 628 and/or to the reference line 658. In the same or other embodiments, however, the reference line may be perpendicular to a longitudinal axis of a downhole cutting or milling tool and/or a wellbore. Optionally, the front flank angle $\beta_f$ may be measured between the front face 632 and a line parallel to the rear face 642 or the rear flank angle $\beta_r$ may be measured between the rear face 642 and a line parallel to the front face 632.

In accordance with embodiments of the present disclosure, the front flank angle $\beta_f$ and rear flank angle $\beta_r$ may be different in various embodiments, and for any number of reasons. For instance, by varying the front flank angle $\beta_f$ relative to the rear flank angle $\beta_r$, a gap may be formed between adjacent cutting inserts 628 in different rows axially spaced along a blade of a milling or other cutting tool. In some embodiments, at least a portion of the trailing edge 657 may contact the front face 632 of an adjacent cutting insert 628, although in other embodiments the trailing edge 657 may not contact the front face 632. Providing a gap between adjacent cutting inserts 628 with front and/or rear flank angles $\beta_f$, $\beta_r$—and potentially in which no additional material fills the gap 275—may improve cutting efficiency while also reducing crack propagation across cutting inserts 628.

The particular measurements of the front and rear flank angles $\beta_f$, $\beta_r$ may, in some embodiments, range from 0° to 25°. For instance, the front flank angle $\beta_f$ may be within a range having lower and/or upper limits that include any of 0°, 1°, 2.5°, 5°, 7.5°, 10°, 12.5°, 15°, 17.5°, 20°, 22.5°, 25°, and any values therebetween. For instance, the front flank angle $\beta_f$ may be between 2.5° and 12.5°, between 5° and 10°, or between 7.5° and 15°. In other embodiments, a cutting insert 628 may have a front flank angle $\beta_f$ greater than 25° or less than 0° (i.e., a negative front flank angle). Similarly, the rear flank angle $\beta_r$ may be within a range having lower and/or upper limits that include any of 0°, 1°, 2.5°, 5°, 7.5°, 10°, 12.5°, 15°, 17.5°, 20°, 22.5°, 25°, and any values therebetween. For instance, the rear flank angle $\beta_r$ may be between 0° and 10°, between 2.5° and 7.5°, or between 5° and 12.5°. In other embodiments, a cutting insert 628 may have a rear flank angle $\beta_r$ greater than 25° or less than 0° (i.e., a negative rear flank angle). As will be appreciated by a person having ordinary skill in the art in view of the disclosure herein, the front flank angle $\beta_f$ may be equal to, less than, or greater than the rear flank angle $\beta_r$.

The cutting insert 628 may have a plurality of ridges 654, teeth, recesses, or other geometries, features, or the like. The ridges 654 illustrated in FIG. 6 may define back-up cutting edges. Each back-up cutting edge may extend the full or partial length of the milling portion 629-2. The ridges 654, cutting edge 653, and recesses may collectively define teeth which each have a tooth width that may be measured as a distance between a ridge 654 and an adjacent ridge 654 or cutting edge 653. According to some embodiments, the ratio of the tooth width to the width of the cutting insert 628 may be between 1:15 and 1:1. In FIG. 6, for instance, the ratio may be 1:5 as there are five (5) teeth of about equal width defined by the cutting edge 653 and four (4) ridges 654. In other embodiments, however, the teeth may have unequal widths or there may be more or fewer than five (5) teeth. For instance, the ratio of the tooth width to the width of a cutting insert may be between 1:10 and 1:2, or between 1:6 and 1:2. In some embodiments, the ratio of the tooth width to the width of the cutting insert may be greater than 1:15. A cutting insert according to the present disclosure may therefore include zero or more teeth, ridges, recesses, or other features. FIGS. 7 to 11 illustrate some additional embodiments of illustrative cutting inserts having varying numbers of teeth, ridges, or other features.

Figure 7:
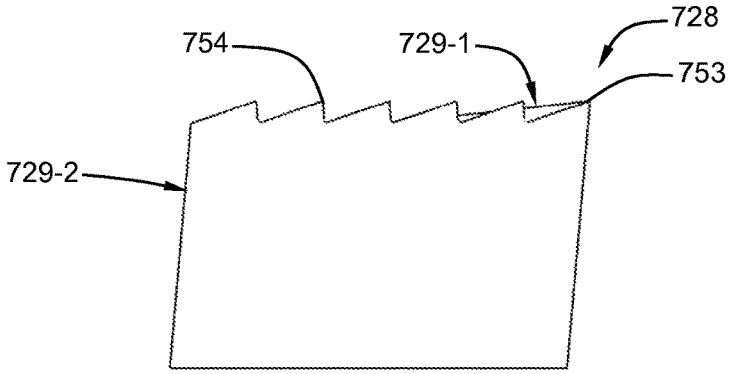

In particular, FIG. 7 is a side profile view of a cutting insert 728 having a turning portion 729-1 and a milling portion 729-2. The cutting insert 728 may be similar to other cutting inserts described herein except for the number of teeth or ridges 754 formed in a top face thereof. In the illustrated embodiment, the cutting insert 728 may include six (6) teeth formed by a cutting edge 753 and five (5) ridges 754.

Figure 8:
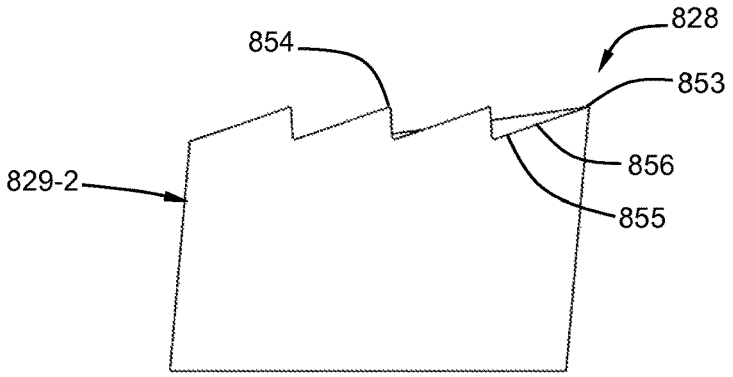

In contrast, the cutting insert 828 of FIG. 8 may include four (4) teeth. More particularly, the milling portion 829-2 of the cutting insert 828 may include a cutting edge 853 and three (3) ridges 843 to collectively define the four (4) teeth. Recesses 855 or other features may also be included to define the teeth of the cutting insert 828. A rake face 856 adjacent the cutting edge 853 or adjacent a ridge 854 may be generally planar, and in some embodiments may be ramped from the corresponding ridge 853 or cutting edge 853 to a lowermost portion of a recess 855. In at least some embodiments, the teeth may have a ramped or saw-tooth shape. In other embodiments, however, the teeth or rake faces, may be curved, may include multiple planar sections (and may define primary and secondary rake angles), may be curved, or may have a combination of the foregoing.

Figure 9:
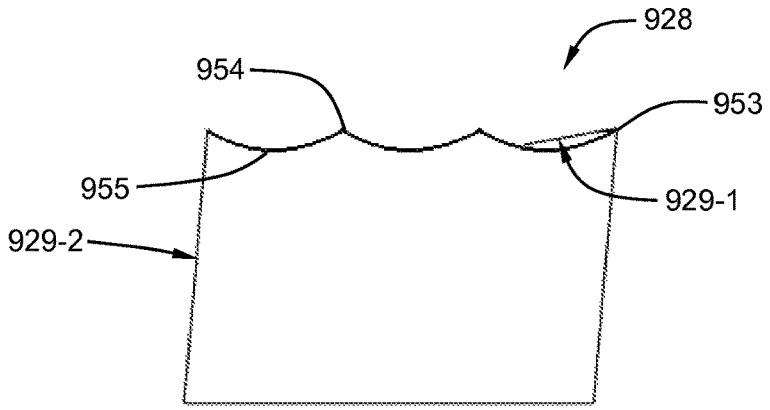

FIG. 9, for instance, illustrates a cutting insert 928 including a turning portion 929-1 and a milling portion 929-2, in which the milling portion 929-2 may include three (3) teeth or other features. In particular, the milling portion 929-2 may include a cutting edge 953 and two (2) ridges 954 cooperating with three (3) recesses 955 to form the teeth. In this particular embodiment, the recesses 955 may be radiused or curved rather than planar or saw-toothed. In other embodiments, the teeth of a cutting element may have still other shapes or contours, or may have a combination of planar, saw-toothed, curved, or other teeth.

Figure 10:
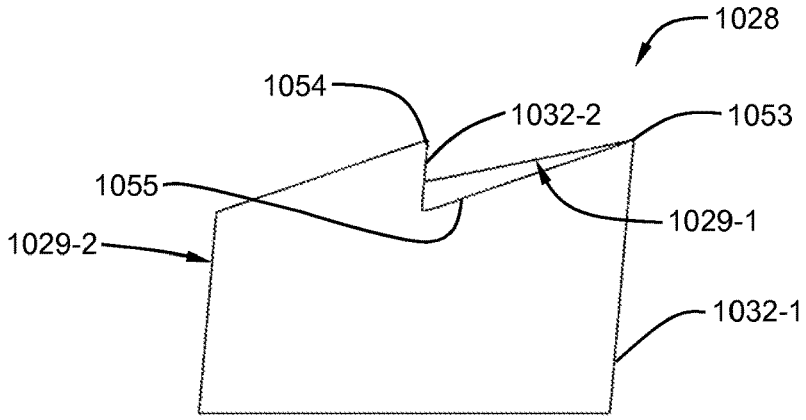

FIG. 10 illustrates another illustrative cutting insert 1028 including a turning portion 1029-1 and a milling portion 1029-2. In this particular embodiment, the milling portion 1029-2 may include two (2) teeth defined by a cutting edge 1053, a ridge 1054, and two (2) recesses 1055. In this particular embodiment, the teeth may also be saw-tooth shaped. In at least this embodiment, however, the cutting insert 1028 may include a front face 1032-1 that is inclined or angled (i.e., having a non-zero front flank angle). In some embodiments, a back-up face 1032-2 extending from the ridge 1054 may be inclined in a same direction, and potentially at a same angle as the front face 1032-1. As a result, as the cutting insert 1028 wears from the cutting edge 1053 toward the ridge 1054, the back-up face 1032-2 may become a new front face 1032-1.

The cutting inserts illustrated in FIGS. 4-1 to 10 are merely illustrative of some example cutting inserts and structures that may be used in a downhole operation to initiate a cutout and optionally perform a face milling operation on the workpiece. In at least some embodiments, the milling and turning portions of the cutting inserts may be separate. Whether the milling portion and turning portion are separate or integral, the milling portion may be rectangular, square, or otherwise shaped. In some embodiments, for instance, the milling portion may have a circular, oval, curved, triangular, polygonal, other cross-sectional or plan shape, or any portion or combination of the foregoing.

Figure 11:
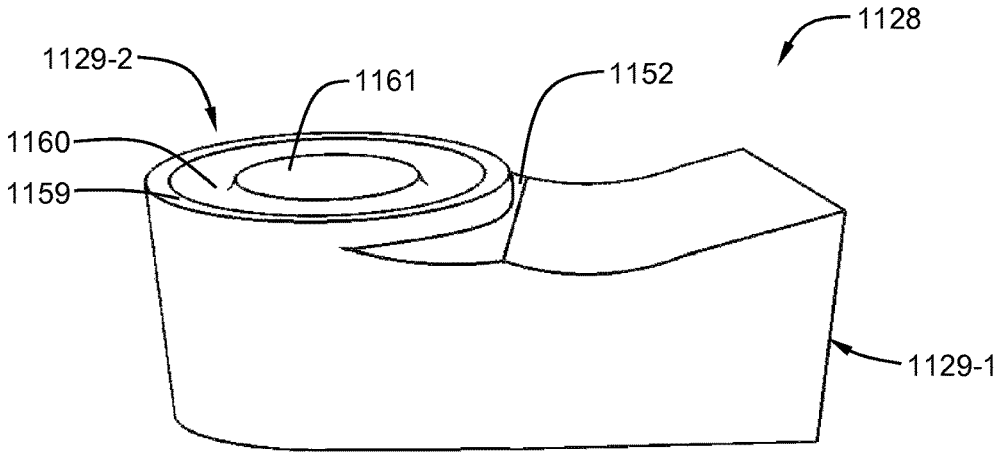
FIG. 11 is a perspective view of another example of a milling insert for initiating a cutout in a downhole casing and for section milling, in accordance with one or more embodiments of the present disclosure.

FIG. 11, for instance, illustrates an example cutting insert 1128 that may include a turning portion 1129-1 and a milling portion 1129-2. In this particular embodiment, the milling portion 1129-2 may have a circular cross-sectional shape. Where the turning portion 1129-1 has a rectangular or other shape (e.g., a shape and structure similar to the cutting insert 429 of FIGS. 4-1 to 4-6), a transition portion 1152 may couple the turning portion 1129-1 to the milling portion 1129-2. In other embodiments, the turning portion 1129-1 and the milling portion 1129-2 may be formed separately and attached to a blade (e.g., of a mill or downhole tool) as separate components.

The milling portion 1129-2 may include any features 1159, 1160, 1161 suitable to facilitate use of the cutting insert 1128 in a face milling operation. For instance, the milling portion 1129-2 may include one or more elevated features 1159, 1161 and one or more recessed features 1160 in a top face or other portion thereof. Optionally, the features 1159, 1160, 1161 may be circular, annular, or have other suitable shapes. In at least some embodiments, the features 1159, 1160, 1161 may be configured to operate a chipbreaker to reduce the size of chips formed from a workpiece being milled.

Figures 1, 12:
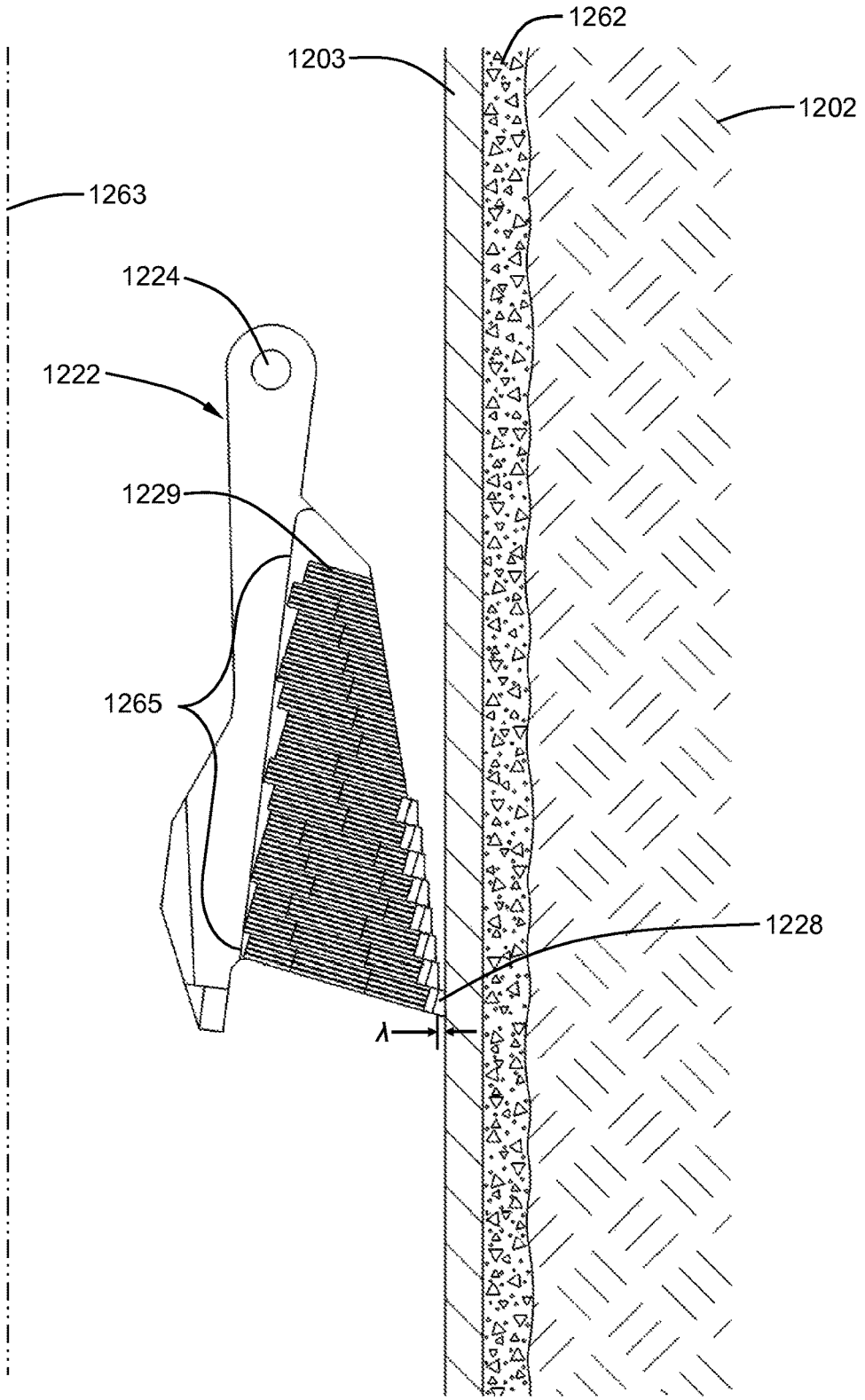
Figures 2, 12:
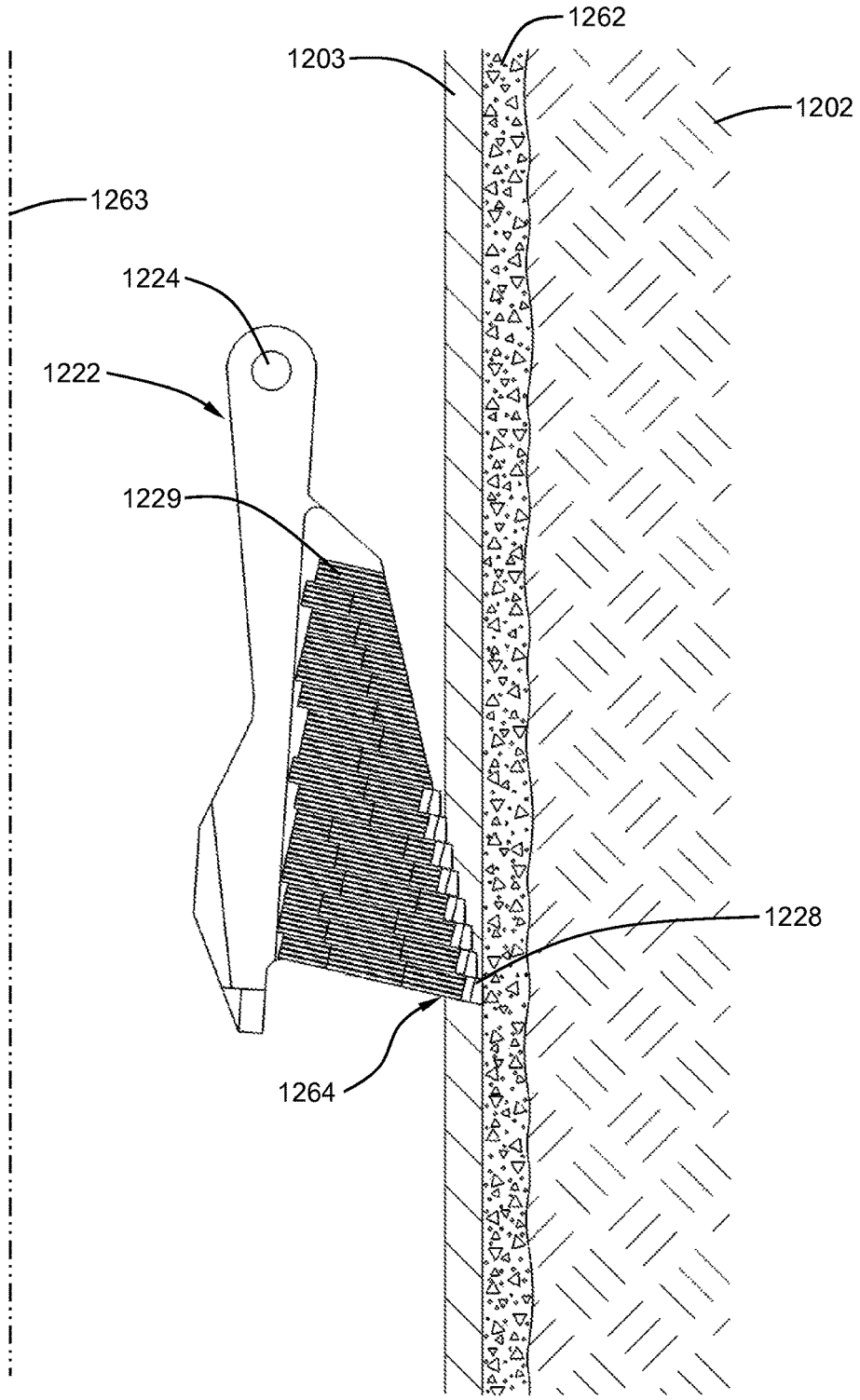
Figures 3, 12:
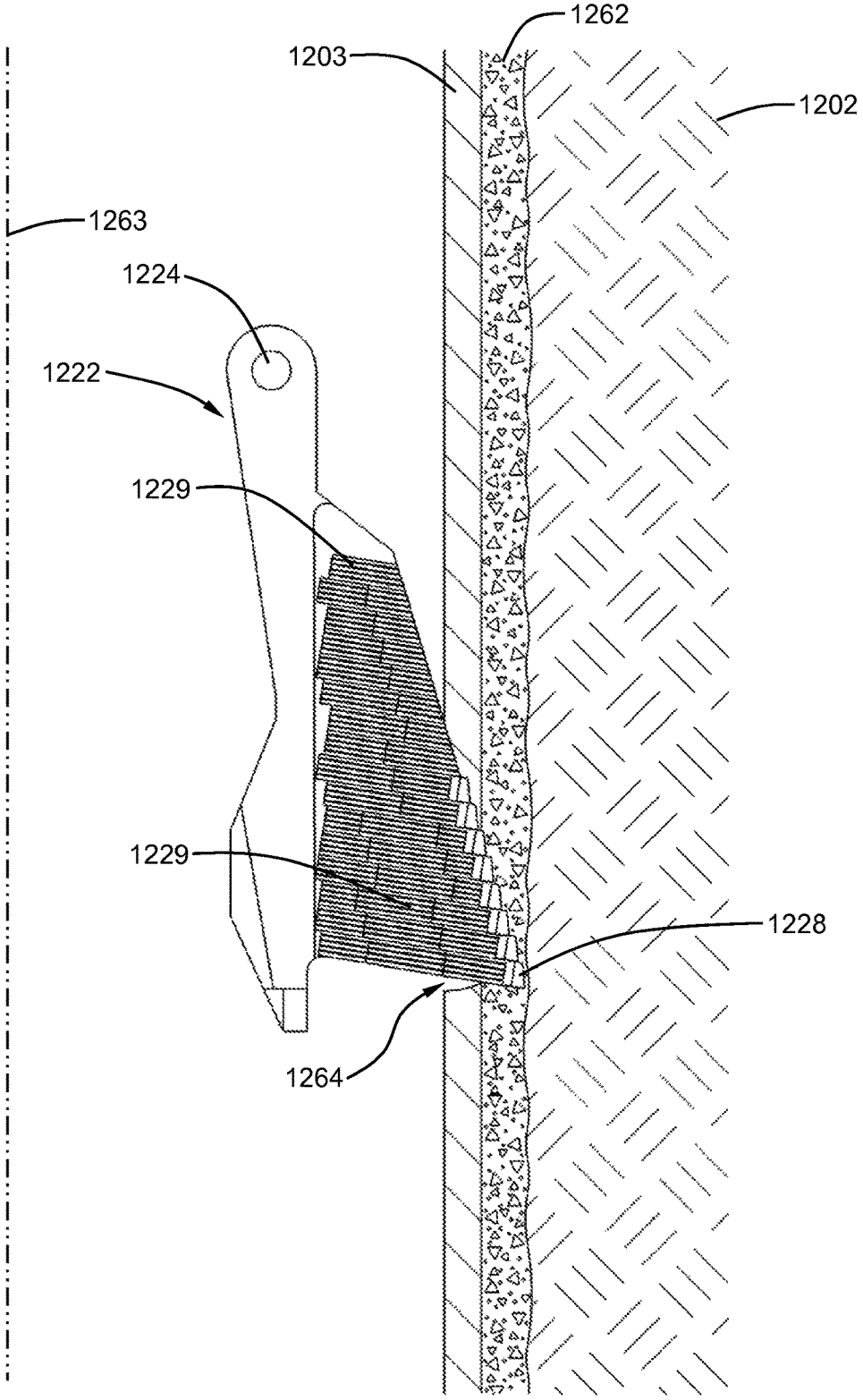
Figures 4, 12:
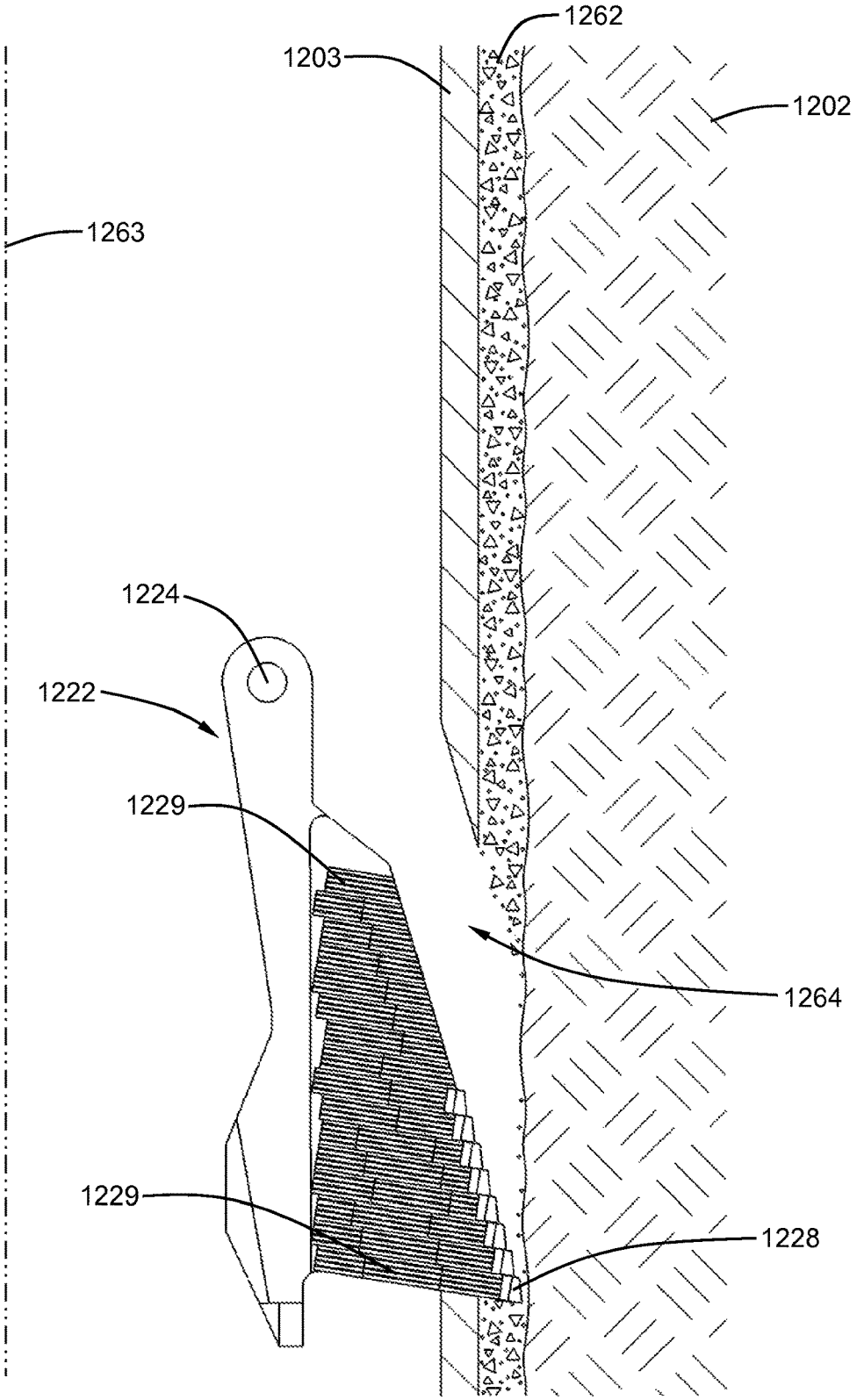

An illustrative method for initiating a cutout in casing will now be described in more detail with respect to FIGS. 12-1 to 12-4. It should be appreciated that any number of different milling tools, blades, and cutting inserts may be used in such a method, including the milling tools, blades, and cutting inserts described herein. Thus, in one embodiment, the milling operation may include cutting inserts of different sizes and shapes, cutting inserts that include turning portions integrally formed with milling portions, cutting inserts that include turning portions separate from cutting inserts with milling portions, or any combination of the foregoing. In FIGS. 12-1 to 12-4, a movable blade 1222 that may be used in a section milling operation is illustrated without other components of the mill or other downhole tool to which the movable blade 1222 is attached. It should be appreciated that this is done to reduce complexity in the drawings and to clarify certain aspects of the illustrated method, and that the movable blade 1222 may be connected to other components of a mill or other downhole tool as described herein or as known in the art.

As shown in FIGS. 12-1 to 12-3, the movable blade 1222 may be inserted into a wellbore within a formation 1202. In this embodiment, the wellbore may have a casing 1203 or other liner therein, and the casing 1203 may optionally be secured in place. The casing 1203 may therefore be downhole casing. In some embodiments, cement 1262 may positioned in an annular region between the exterior of the casing 1203 and the formation 1202 to, at least in part, secure the casing 1203 at a particular longitudinal and/or rotational position along and within the wellbore.

The movable blade 1222 may include multiple cutting inserts 1228, and potentially multiple different types of cutting inserts 1228, 1229. In FIGS. 12-1 to 12-4, for instance, the cutting inserts 1228, 1229 may be located on a leading surface of the movable blade 1222 (i.e., facing forwardly in the direction of rotation of the tool). Each cutting insert 1228, 1229 may be coupled to the movable blade 1222 by any convenient or suitable mechanism, including by brazing, welding, or soldering. The cutting inserts 1228, 1229 may be positioned in axial rows 1265. In FIG. 12-1, for instance, the lower six (6) rows of the axial rows 1265 may include three or more cutting inserts 1228, 1229 located in an abutting relationship and side-by-side to one another. The nine (9) rows of the axial rows 1265 immediately axially above the lowermost rows may include two or more cutting inserts 1228, 1229 abutting one another side-by-side. The uppermost row of the axial rows 1265 may include a single cutting insert 1228 or 1229. Each of the rows 1265 may be located or offset in a longitudinal direction one above another. Optionally, each of the rows 1265 may be staggered with respect to an adjacent row such edges of cutting inserts 1228, 1229 may not align with edges of cutting inserts 1228, 1229 in an adjacent row. In some embodiments, rows may be staggered by having a cutting insert 1228, 1229 of one row offset from a cutting insert 1228, 1229 of an adjacent row by about half the radial length of a cutting insert 1228, 1229, to thereby form a brickwork pattern.

As the movable blade 1222 and corresponding downhole tool are inserted into the wellbore, the movable blade 1222 may be in a retracted position. In the retracted position, the diameter of the downhole tool may be less than or about equal to the internal diameter of the casing 1203, thereby allowing the downhole tool to be advanced axially through the wellbore. Upon reaching a desired depth or position, the movable blade 1222 may be activated and expanded. In this particular embodiment, the movable blade 1222 may be connected to a pivot 1224 located above the cutting inserts 1228, 1229 on the movable blade 1222. Mechanical, hydraulic, or other components may cause the movable blade 1222 to rotate and pivot around the pivot 1224 until one or more of the cutting inserts 1228, 1229 coupled to the movable blade 1222 are in contact with the inner surface of the casing 1203.

As seen in FIGS. 12-1 to 12-3, as the movable blade 1222 is expanded radially outward and into engagement with the casing 1203, cutting inserts 1228, 1229 within some of the rows 1265 may first contact the casing 1203. The radial outermost portion of the movable blade 1222, or the cutting inserts 1228, 1229 on the movable blade 122, which first contacts and engages the casing 1203 may be referred to as the cutout initiation region of the movable blade 1222. In accordance with some embodiments of the present disclosure, the portion of the rows 1265 of cutting elements 1228, 1228 in the cutout initiation region may be arranged to initiate the cutout by using a turning action rather than, or in addition to, a face-milling action. For instance, upon expanding the movable blades 1222, the downhole tool may be rotated around a longitudinal axis 1263 of the wellbore or tool. As the downhole tool rotates, the cutting inserts 1228, 1229 in the cutout initiation region and in contact with the casing 1203 may initiate a cutout 1264. In at least some embodiments, the cutting inserts 1228 (or turning portions of the cutting inserts 1228) may be located in the cutout initiation region, and at least some of the cutting inserts 1229 may be located outside of the cutout initiation region.

FIGS. 12-1 to 12-3 sequentially illustrate the initiation of a cutout 1264 within the casing 1203. In this particular embodiment, the cutout initiation region of the movable blade 1222 may include at least one cutting insert 1228 that first makes contact with the casing 1203. Where the cutting inserts 1228 includes a turning portion with features configured to cut in a turning fashion, the turning portion and features (e.g., side cutting edge and end cutting edge) may operate as a turning or lathe tool to mill the casing 1203 and initiate and form the cutout 1264. If the cutting inserts first making contact with the casing 1203 includes milling features or portions but do not include turning features, the cutting inserts may have sufficient material hardness to cause the cutout 1264 to form; however, it may do so less efficiently than a cutting insert 1228 with turning features, or with the potential of increased damage to the cutting insert. In this particular embodiment, eight (8) cutting inserts 1228 are located at the outermost radial edge of the movable blade 1222, with one (1) cutting insert 1228 on each of the lowermost eight (8) rows 1265. The cutting inserts 1228 may be used to initiate the cutout 1264. In other embodiments, however, a single cutting insert 1228 may be used (e.g., on the lowermost one of the rows 1265), between one (1) and eight (8) cutting inserts 1228 may be used, or more than eight (8) cutting inserts 1228 may be used. Additionally, the cutting inserts 1228 may be otherwise organized or arranged (e.g., multiple cutting inserts 1228 on the same row, cutting inserts 1228 not on adjacent rows, etc.) while still used to initiate the cutout 1264. In some embodiments, regardless of the number or arrangement of the cutting inserts 1228, the turning portions of the cutting inserts 1228 may include features and angles that do not match the shape or contour of the outer radial edge of the movable blade 1222. Such features may operate as a turning tool that more efficiently initiates a cutout than cutting inserts with milling portions angled to match the edge profile of the movable blade 1222, or which are otherwise arranged for use in face milling.

The cutting inserts 1228 at the radial outermost end of some or each of the rows 1265 may be arranged to have the lower radial outer corner in alignment with an outer, sloping edge of the movable blade 1222. In other embodiments, at least some of the cutting inserts 1228, 1229 may be at least partially offset from the outer, sloping or radial edge of the movable blade 1222. In FIG. 12-1, for instance, the cutting inserts 1228 at the radial outermost ends the corresponding rows 1265 are shown as being offset and extended radially outward from the outer, sloping edge of the movable bade 1222 by an overhang distance λ. The overhang distance λ may be varied in different embodiments, and may be based on the size of the movable blade 1222, the size of the cutting insert 1228, or other criteria. In at least some embodiments, the overhang distance λ may be between 1/1000 inch (0.03 mm) and 1 inch (25.40 mm). For instance, the overhang distance λ may be within a range having lower and/or upper limits that include any of 1/1000 inch (0.03 mm), 1/500 inch (0.05 mm), 1/200 inch (0.13 mm), 1/100 inch (0.25 mm), 1/50 inch (0.51 mm), 1/20 inch (1.27 mm), 1/10 inch (2.54 mm), 1/5 inch (5.08 mm), 1/4 inch (6.35 mm), 1/3 inch (8.47 mm), 1/2 inch (12.70 mm), 3/4 inch (19.05 mm), 1 inch (25.40 mm), and any values therebetween. For instance, the overhang distance λ may be between 1/1000 inch (0.03 mm) and 1/2 inch (12.70 mm), between 1/1000 inch (0.03 mm) and 1/10 inch (2.54 mm), between 1/1000 inch (0.03 mm) and 1/20 inch (1.27 mm), between 1/1000 inch (0.03 mm) and 1/50 inch (0.51 mm), or between 1/2 inch (12.70 mm) and 1 inch (25.40 mm). In other embodiments, the overhang distance λ may be less than 1/1000 inch (0.03 mm) or greater than 1 inch (25.40 mm). The overhang distance λ may be the same for each of the cutting inserts 1228, or the overhang distance λ may be different for some or each of the cutting inserts 1228.

As discussed herein, the cutting inserts 1228 may include a turning portion to cut the casing 1203 in a turning fashion. The cutting inserts 1228 may also include a milling portion, or may be separate from cutting inserts 1229 which include milling features and portions but lack turning portions and features. For instance, the cutting inserts 1228 may be similar to the cutting insert 428 of FIGS. 4-1 to 4-6. In other embodiments, the cutting inserts 1228 may be similar to the cutting inserts 528, 628, 728, 828, 928, 1028, or 1128 of FIG. 5-1 to FIG. 11. Regardless of the particular structure of the cutting inserts 1228, as the movable blade 1222 pivots about the pivot 1224 and expands to contact the casing 1203, rotation of the movable blade 1222 may allow the cutting inserts 1228 to cut into the casing 1203 to initiate formation of the cutout 1264. By continuing to pivot around the pivot 1224, the movable blade 1222 may move farther radially outward and the cutout 1264 may become deeper and taller. As a result, the cutting inserts 1228, 1229 may completely cut through the casing 1203. Due to rotation of the movable blade 1222, the cutout 1264 may extend circumferentially around the casing 1203. Upon cutting through the casing 1203 and forming the cutout 1264, one or more cutting inserts 1229, or milling portions of the cutting inserts 1228 may be radially aligned with the casing 1203. The cutting inserts 1229 or milling portions of the cutting inserts 1228 may be configured to operate as a face mill and cut the casing 1203 as the movable blade 1222 moves axially or parallel to the longitudinal axis 1263. While moving axially, the movable blade 1222 may continue to rotate.

FIG. 12-4 illustrates an example embodiment in which the movable blade 1222 has been moved in an axially downward or downhole direction. As the movable blade 1222 moves axially downward, the cutting inserts 1228 and/or the cutting inserts 1229 may perform a face milling function and mill and grind away a portion of the casing 1203, thereby extending a length of the cutout 1264. In this particular example, there is a single casing 1203, and milling the casing 1203 and corresponding cement 1262 may expose the formation 1202, thereby creating an openhole section 1263 of the wellbore. As the movable blade 1222 may continue to rotate while moving axially, the openhole section 1263 may extend around the circumference of the wellbore. In at least some embodiments, the depth of cut by the movable blade 1222 may be modified. For instance, the cement 1262 may not be milled through, or the formation 1202 may be at least partially milled. In another embodiment, there may be multiple casing layers, and milling the casing 1203 may include milling a single casing 1203 so that the formation is not exposed, or multiple casings may be simultaneously milled. When multiple casings are milled, the cutting insert 1228 may initiate a cutout in one casing, or potentially in each casing. Additionally, milling multiple casings may expose the formation 1202, or fewer than the total number of casing layers may be milled so that the formation is not exposed.

Figure 13:
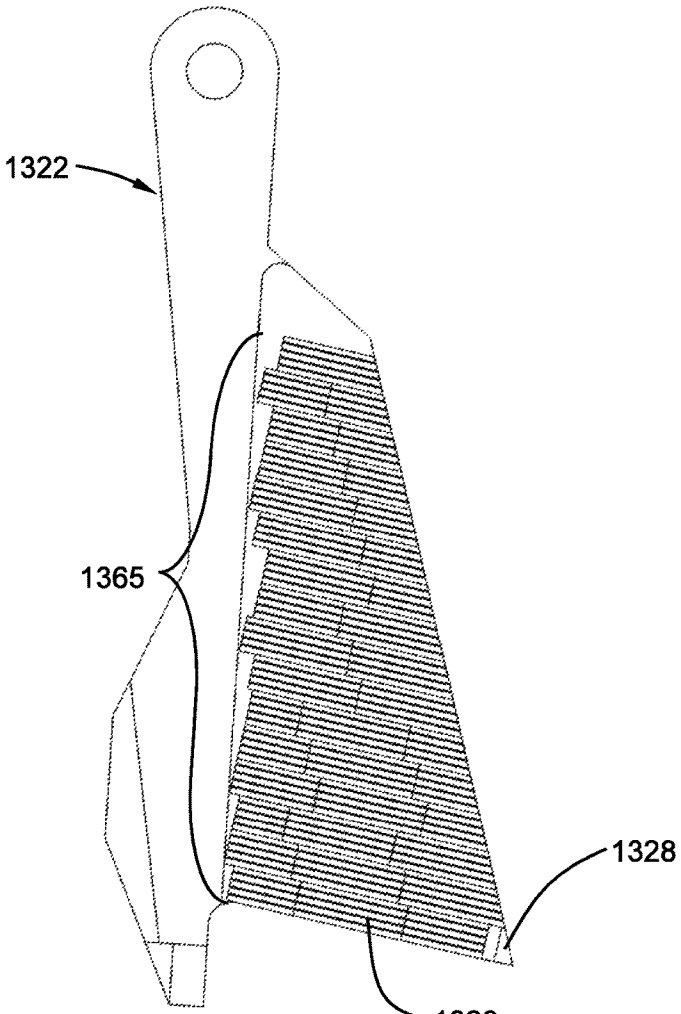
FIG. 13 is a side view of an example section mill blade, in accordance with one or more embodiments of the present disclosure.

The movable blade 1222 may be modified in any number of manners while continuing to provide one or both of a cutout initiation and section milling function. For instance, the movable blade 1222 may have more or fewer rows of cutting inserts 1228, 1229, more or fewer cutting inserts 1228 for initiating the cutout 1264, the cutting inserts 1228, 1229 may be aligned in different manners (e.g., in columns rather than rows, in columns and rows, etc.), the cutting inserts 1228, 1229 may be made of different materials, or other changes may be made. As discussed herein, in some embodiments, the cutting inserts 1228 may be offset from the outer radial edge of the movable blade 1222 by an overhang distance λ. The cutting inserts 1228 may be offset to be suspended from the movable blade 1222 as shown in FIG. 12-1, but in other embodiments may be offset radially inward. The overhang distance λ may therefore also be referred to as an offset distance in which one or more of the cutting inserts 1228 may be offset radially inward or outward relative to the outer radial edge of the movable blade 1222. In at least some embodiments, the movable blade 1222 may itself include or define a turning portion and turning features at the radially outermost edge thereof, so that cutting inserts 1228, 1229 may be offset radially inward relative to the turning portion. Thus, the movable blade 1222, rather than the cutting inserts 1228, 1229 may be used to initiate a cutout. In other embodiments, there may not be any offset or overhang distance λ. FIG. 13, for instance, illustrates another example movable blade 1322 having a series of cutting inserts 1328, 1329 arranged in rows 1365. In this particular embodiment, there is a single cutting insert 1328 with a turning portion; however, the cutting insert 1328 may not be radially offset from the outer radial edge of the movable blade 1322.

Figure 14:
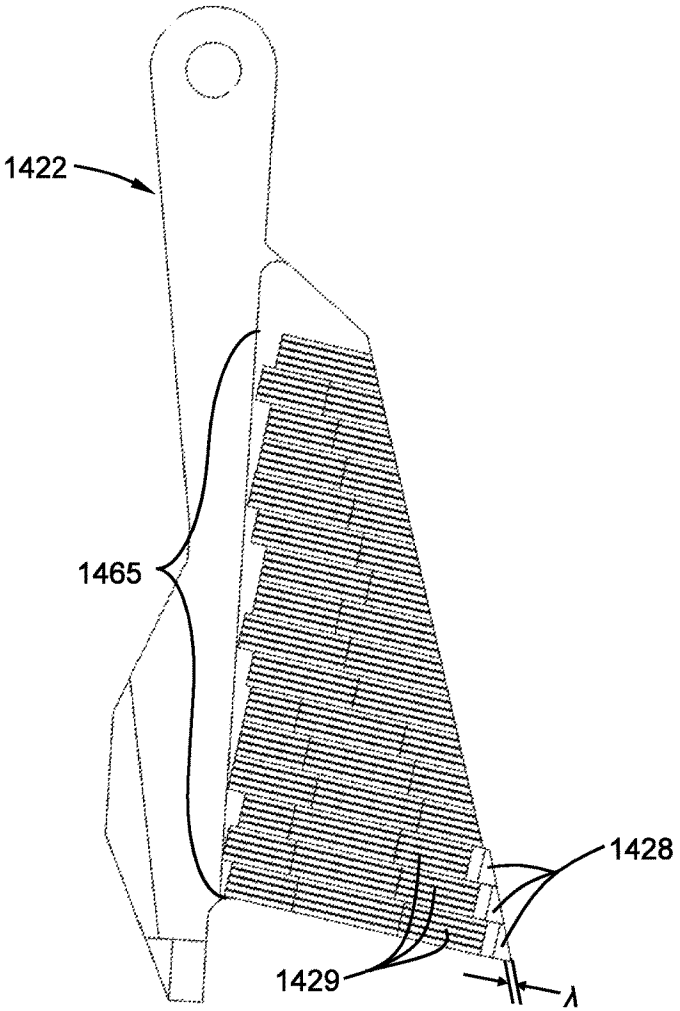
FIG. 14 is a side view of another example section mill blade, in accordance with one or more embodiments of the present disclosure.

In other embodiments, a movable blade or milling tool may include more than one cutting insert with turning features or portions. FIG. 14, for instance, illustrates a movable blade 1422 of a section mill, and includes multiple rows 1465 of cutting inserts 1428, 1429 coupled to the movable blade 1422. In this particular embodiment, three (3) cutting inserts 1428 with turning features or portions may be positioned on a cutout initiation region of the movable blade 1222. More particularly, each of the three (3) lowermost rows of cutting inserts may include a cutting insert 1428 at the outer radial edge thereof. The number of cutting inserts 1428 configured to cut casing or another workpiece by using turning features may be varied, as may the number of rows which include such a cutting insert 1428. In some embodiments, for instance, two (2) rows may include a cutting insert 1428. In other embodiments, four (4), five (5), or more rows (or even each row of the rows 1465), may include a cutting insert 1428.

In accordance with at least some embodiments, the number of cutting inserts on a movable blade and which include turning portions (e.g., cutting inserts 1428) may be less than the total number of cutting inserts on the movable blade (e.g., cutting inserts 1428, 1429). In at least some embodiments, the percentage of cutting inserts that include a turning portion may be between 0.5% and 60% of the total number of cutting inserts. For instance, the percentage of the cutting inserts with turning portions to the total number of cutting inserts may be within a range having lower and/or upper limits that include any of 0.5%, 1%, 1.5%, 2%, 2.5%, 3%, 4%, 5%, 6%, 7%, 8%, 9%, 10%, 15%, 20%, 25%, 30%, 40%, 50%, 60%, and any values therebetween. For instance, the percentage may be between 0.5% and 15%, between 1% and 10%, between 2% and 8%, between 0.5% and 50%, or between 5% and 50%. In a more particular embodiment, the percentage of cutting inserts on a movable blade and which include turning portions may be 7.5%. In other embodiments, the percentage may be less than 0.5% or greater than 60%.

The cutting inserts 1428 in FIG. 14 are also shown as being optionally offset from the outer radial edge of the movable blade 1422 by an overhang distance λ. As discussed herein, the extent or direction of the offset may be different for various embodiments. In at least some embodiments, the ratio of the overhang distance λ to the total length of a cutting insert 1428 may be between 1:1000 and 1:2. For instance, the ratio of the overhang distance λ to the total length of a cutting insert 1428 may be within a range having lower and/or upper limits that include any of 1:1000, 1:500, 1:250, 1:100, 1:50, 1:25, 1:10, 1:7.5, 1:5, 1:4, 1:3, 1:2, and any values therebetween. For instance, the ratio may be between 1:500 and 1:5, between 1:1000 and 1:10, or between 1:100 and 1:4. In other embodiments, the ratio may be less than 1:1000 or greater than 1:2. Additionally, where the cutting insert 1428 includes both a turning portion and a milling portion, the length of the cutting insert 1428 used to determine the ratio may be the length of the turning portion or the total length of the cutting insert 1428.

A downhole tool may itself be modified in any number of ways while still using cutting inserts according to various embodiments of the present disclosure. For instance, as discussed herein, a section mill or other milling tool may include a single blade or multiple blades. Each of multiple blades may be identical in size, shape, and configuration, and may also be dressed identically with various cutting inserts. In other embodiments, blades may be different. For instance, two (2) blades, knives, or other components of a milling tool may have different types or shapes of cutting inserts, different patterns or positions of cutting inserts, or different structural sizes, shapes, or other configurations.

Figure 15:
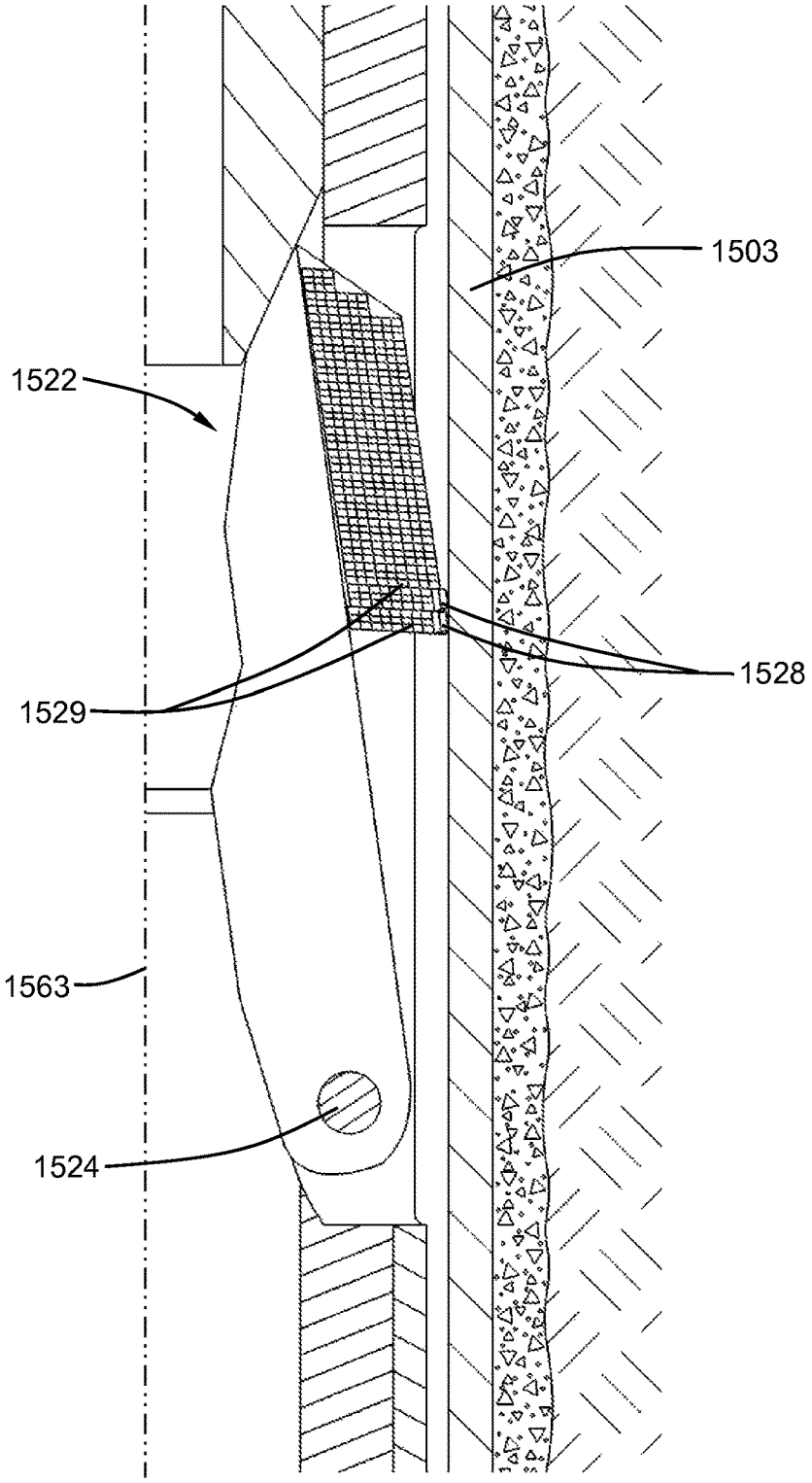
FIG. 15 is a partial cross-sectional view of an example section mill, in accordance with one or more embodiments of the present disclosure.

FIG. 15 illustrates another example milling tool which may be used in accordance with some embodiments of the present disclosure. In this particular embodiment, the milling tool may include a movable blade 1522 with multiple cutting inserts 1528, 1529 coupled thereto. In at least some embodiments, the movable blade 1522 may be configured to respond to mechanical, hydraulic, or other forces and radially expand and contract by rotating around a pivot 1524. In contrast to the movable blade 1222 and pivot 1224 of FIG. 12-1, however, the pivot 1524 may be located axially below or downhole relative to the cutting inserts 1528, 1529.

The movable blade 1522 may expand radially outward and be rotated around a longitudinal axis 1563 to cause a cutout initiation region of the movable blade 1522 to engage the casing 1503 to initiate a cutout before an openhole section is fully formed. In this particular embodiment, the cutout initiation region of the movable blade 1522 may include two (2) cutting inserts 1528 with turning features or portions. The cutting inserts 1528 may be in the same radial position on different rows (e.g., at the outer radial edge of the movable blade 1522), at the same axial position but different radial positions (e.g., in the same row), or they may be at different axial and radial positions. When the cutout is initiated by the movable blade 1522, the downhole tool may move the movable blade 1522 in an axial, downward or downhole direction to mill axially along the casing 1503. In some embodiments, the movable blade 1522 may be positioned with the pivot 1525 axially above the cutting inserts 1528, 1529. In such an embodiment, the downhole tool may move the movable blade 1522 in an axial, upward or uphole direction to mill axially along the casing 1503. In some embodiments, the cutting inserts 1528 may include turning features or portions, while in other embodiments the cutting inserts 1528 may include both turning features or portions and milling features or portions. Accordingly, the same cutting insert 1528 may be used to both initiate the cutout in a predetermined, turning manner, and to mill axially along a length of the casing 1503. The cutting inserts 1529 may include milling features and may potentially not have turning features.

Figure 16:
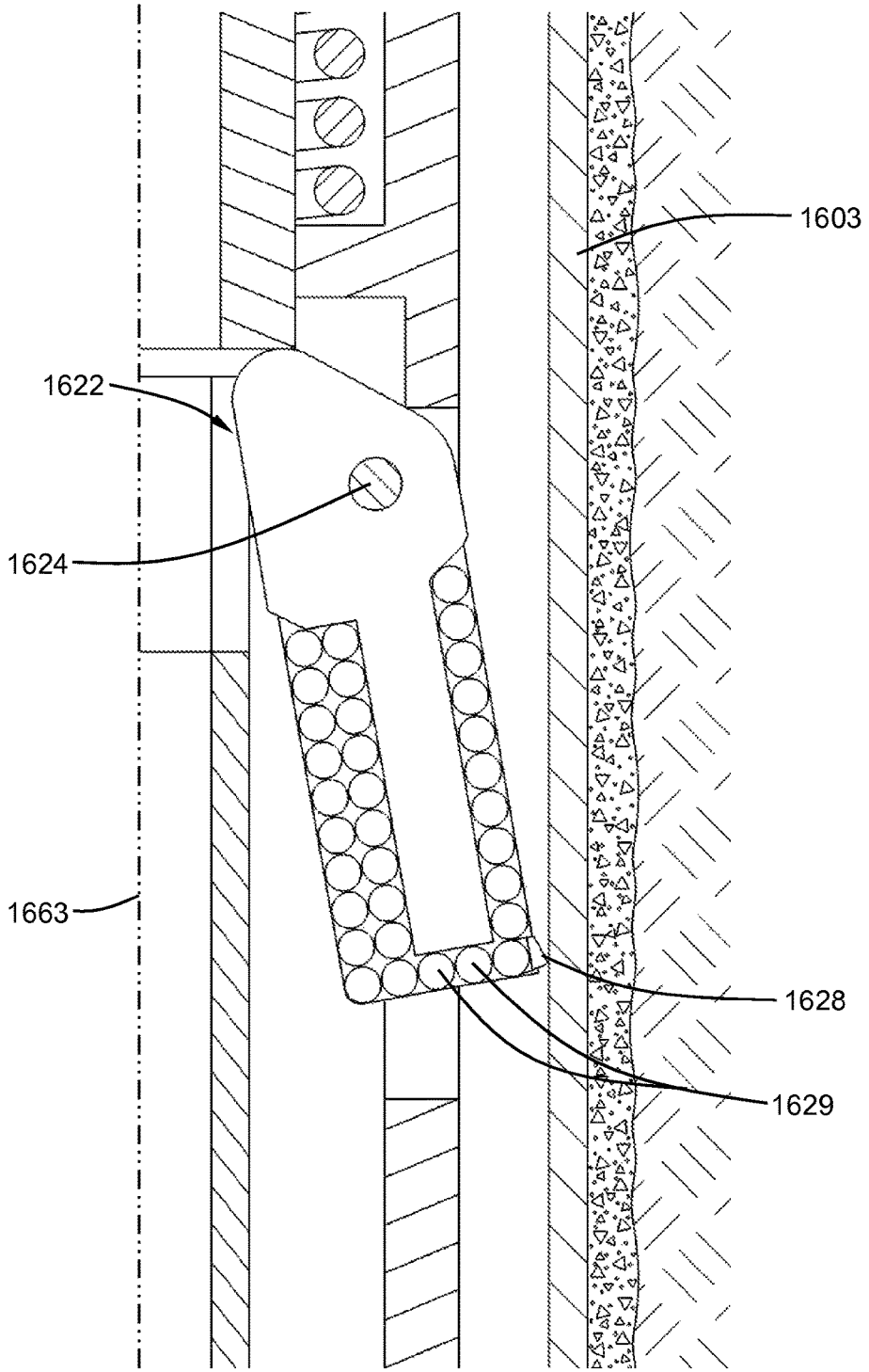
FIG. 16 is a partial cross-sectional view of another example section mill, in accordance with one or more embodiments of the present disclosure.

FIG. 16 illustrates yet another example embodiment of a milling tool which may be used or designed in accordance with embodiments of the present disclosure. In this embodiment, the milling tool may include a milling blade 1622 with multiple cutting inserts 1628, 1629 coupled thereto. In at least some embodiments, the movable blade 1622 may respond to mechanical, hydraulic, or other forces and radially expand or contract (e.g., by sliding along a set of one or more grooves, or rotating around a pivot 1624).

As the movable blade 1622 pivots or otherwise expands or moves in a radially outward direction, the movable blade 1622 may be rotated around a longitudinal axis 1663 to cause a cutout initiation region of the movable blade 1622 to engage the casing 1603 to initiate a cutout in the casing 1603. In this particular embodiment, the cutout initiation region of the movable blade 1622 may include one (1) cutting insert 1628 at a lowermost and outermost edge of the movable blade 1622, so that the cutting insert 1628 may be the first portion of the movable blade 1622 to contact the casing 1603 when the movable blade 1622 is expanded or activated. In other embodiments, however, the movable blade 1622 may include more cutting inserts 1628, or the cutting inserts 1628 may be located at additional or other locations. The cutting inserts 1628 may include one or more cutting edges or other features configured to allow the portion of the cutting insert 1628 contacting the casing 1603 to operate in a predetermined manner as a turning tool. As the movable blade 1622 rotates, the turning tool features may therefore cut the casing 1603 to initiate the cutout of the casing 1603. When the cutout is initiated by the movable blade 1622, the downhole tool and the movable blade 1622 may be urged in an axial direction (e.g., upward or uphole, or downward or downhole) to mill axially along the casing 1603.

The cutting inserts 1628, 1629 may have any suitable shape or configuration for performing a respective milling or turning operation. In FIG. 16, for instance, the cutting inserts 1629 may be circular or cylindrical, and may be arranged in rows, columns, or in other manners on the movable blade 1622. In other embodiments, the cutting inserts 1629 may be rectangular (see cutting inserts 1529 of FIG. 15), triangular, elliptical, semi-circular or semi-cylindrical, pyramidal, or have other shapes, features, or configurations. In accordance with some embodiments, the cutting insert 1628 may include cutting edges or features for operation as a turning tool and milling features for performing face milling or axial milling of the casing 1603. In other embodiments, the cutting insert 1628 may not include milling features for face milling or axial milling.

In the description herein, various relational terms are provided to facilitate an understanding of various aspects of some embodiments of the present disclosure. Relational terms such as "bottom," "below," "top," "above," "back," "front," "left", "right", "rear", "forward", "up", "down", "horizontal", "vertical", "clockwise", "counterclockwise," "upper", "lower", and the like, may be used to describe various components, including their operation and/or illustrated position relative to one or more other components. Relational terms do not indicate a particular orientation for each embodiment within the scope of the description or claims. For example, a component of a BHA that is described as "below" another component may be farther from the surface while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between similar components. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or commonly machined from the same piece of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in an oil, gas, or other hydrocarbon exploration nor production environment, such environment is merely illustrative. Systems, tools, assemblies, cutting inserts, methods, and other components of the present disclosure, or which would be appreciated in view of the disclosure herein, may be used in other applications and environments. In other embodiments, cutting inserts, cutting tools, milling tools, methods of milling, methods of cutting, methods of initiating a cutout, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide lower and/or upper limits. It should be appreciated that any particular value may be used alone or to define a range (e.g., 7.5 mm, at least 7.5 mm, up to 7.5 mm), or ranges may include the combination of any two values. Any numerical value is "about" or "approximately" the indicated value, and takes into account experimental error and variations that would be expected by a person having ordinary skill in the art. Any numbers, percentages, ratios, measurements, or other values stated herein are therefore intended to include the stated value as well as other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 5%, within 1%, within 0.1%, or within 0.01% of a stated value.

The abstract included with this disclosure is provided to allow the reader to quickly ascertain the general nature of some embodiments of the present disclosure. It is submitted with the understanding that it will not be used to interpret or limit the scope or meaning of the claims.

What is claimed is:

1. A cutting insert, comprising:

a first portion having features arranged to cut radially through and into a workpiece having an outer surface, at least when the first portion has radially cut to a distance such that the entire first portion is beyond the workpiece outer surface, the first portion having a first length, the first portion features including:

a front milling face; and a top milling face coupled to the front milling face at a milling cutting edge;

a second portion having features arranged to mill axially along a workpiece, the second portion coupled to the first portion and having a second length, the first and second lengths collectively defining a total length, the second portion features including:

a front turning face coupled to the front milling face;

a top turning face coupled to the front turning face at a side cutting edge, the side cutting edge being at a non-zero side cutting edge angle relative to a first reference line parallel to the total length; and an end turning face coupled to the top turning face at an end cutting edge, the end cutting edge being at a non-zero end cutting edge angle relative to a second reference line perpendicular to the first reference line.

2. The cutting insert of claim 1, the front milling face being planar.

3. The cutting insert of claim 1, the side cutting edge angle being between 1° and 20°.

4. The cutting insert of claim 1, the front turning face coupled to the end turning face at a front edge.

5. The cutting insert of claim 4, the front edge having an end relief angle between 1° and 20°.

6. The cutting insert of claim 4, the front edge having a side relief angle between 1° and 20°.

7. The cutting insert of claim 4, a side rake angle of the end cutting edge is between 2° and 8°;

a back rake angle of the side cutting edge is between 2° and 8°;

the side cutting edge angle is between 1° and 5°;

the end cutting edge angle is between 2° and 8°; and at least one of an end or side relief angle of the front edge is between 1° and 5°.

8. The cutting insert of claim 1, the front milling face being oriented at a non-zero front flank angle.

9. The cutting insert of claim 1, a ratio of the second length to the first length being between 1:10 and 1:1.

10. The cutting insert of claim 1, the front milling face and the front turning face being coupled to a bottom face opposing the top milling face and the top turning face, a distance between the bottom face and the top turning face defining a height of the second portion.

11. The cutting insert of claim 1, the first and second portions being formed together from at least one superhard material.

12. A section mill for milling a tubular having an outer surface, comprising:

a body; and a movable blade movably coupled to the body, the movable blade including a plurality of cutting inserts coupled thereto, the plurality of cutting inserts including:

at least one first cutting element positioned along at least a portion of an outer radial edge of the movable blade to initiate a cutout radially, the at least one first cutting element including a radially outer portion including:

a front turning face;

a top turning face coupled to the front turning face at a side cutting edge, the side cutting edge being at a non-zero side cutting edge angle relative to a first reference line parallel to a radial length of the at least one first cutting element; and an end turning face coupled to the top turning face at an end cutting edge, the end cutting edge being at a non-zero end cutting edge angle relative to a second reference line perpendicular to the first reference line; and at least one second cutting element on the movable blade and positioned radially inward of the at least one first cutting element to extend the cutout axially at least when the at least one first cutting element has radially cut to a distance such that a radially outermost first cutting element of the at least one first cutting element is entirely beyond the outer surface of the tubular, the at least one second cutting element having a different shape than the at least one first cutting element.

13. The section mill of claim 12, the side cutting edge and the end cutting edge of the at least one first cutting element defining at least two turning cutting edges.

14. The section mill of claim 13, the at least two turning cutting edges being located at the outer radial edge of the movable blade.

15. The section mill of claim 14, at least a portion of each of the at least two turning cutting edges overhanging the outer radial edge of the movable blade.

16. The section mill of claim 12, the at least one first cutting element including a plurality of first cutting elements only on the outer radial edge of the movable blade, and the at least one second cutting element including a plurality of second cutting elements positioned both radially inward of the outer radial edge of the movable blade and on the outer radial edge of the movable blade.

17. The section mill of claim 12, the at least one first cutting element including a radially inner portion having a front milling face coupled to the front turning face, and a top milling face coupled to the front milling face at a milling cutting edge.

18. The section mill of claim 17, the shape of the at least one second cutting element corresponding to a shape of the radially inner portion of the at least one first cutting element.

19. The section mill of claim 12, the length of the at least one first cutting element being a total length formed by a first length of the radially outer portion and a second length of the radially inner portion, the first length being less than the second length.

* * * * *